US005425151A

United States Patent [19]

Iura

[11] Patent Number: 5,425,151

[45] Date of Patent: Jun. 20, 1995

[54] ROTARY, INVALID BED

[76] Inventor: Tadashi Iura, 172-4, Befucho, Matsuyama-shi, Ehime791, Japan

[21] Appl. No.: 323,575

[22] Filed: Oct. 17, 1994

Related U.S. Application Data

[60] Continuation of Ser. No. 181,083, Jan. 13, 1994, abandoned, which is a division of Ser. No. 651,371, Dec. 26, 1991, abandoned.

[30] Foreign Application Priority Data

| | | | |
|---|---|---|---|
| Jun. 26, 1989 | [JP] | Japan | 1-165004 |
| Jun. 30, 1989 | [JP] | Japan | 1-170021 |
| Jul. 1, 1989 | [JP] | Japan | 1-169999 |
| Jul. 1, 1989 | [JP] | Japan | 1-170000 |
| Aug. 17, 1989 | [JP] | Japan | 1-211795 |

[51] Int. Cl.[6] ..... A61G 7/015; A61G 7/00

[52] U.S. Cl. ..... 5/618; 5/613

[58] Field of Search ..... 5/618, 613, 616, 617, 5/600, 610

[56] References Cited

U.S. PATENT DOCUMENTS

| | | | |
|---|---|---|---|
| 3,090,971 | 5/1963 | MacDonald | 5/618 |
| 3,239,853 | 3/1966 | MacDonald | 5/618 |
| 4,139,917 | 2/1979 | Fenwick | 5/618 |

FOREIGN PATENT DOCUMENTS

| | | | |
|---|---|---|---|
| 84835 | 5/1958 | Denmark | 5/617 |
| 86424 | 1/1930 | Japan . | |
| 52-27472 | 7/1977 | Japan . | |
| 2095545 | 10/1982 | United Kingdom . | |
| 1259181 | 1/1992 | United Kingdom . | |

*Primary Examiner*—Alexander Grosz

*Attorney, Agent, or Firm*—Nikaido, Marmelstein, Murray & Oram

[57] ABSTRACT

A rotary type bed which moves from a condition that a physically handicapped person or an aged person is laying down to a condition that the person raises the upper half of the body thereof and sits sideward, or from the condition of sitting sideward to the condition of laying down. The bed is divided into a front bed section and a rear bed section, and provided with a pivoting mechanism to pivot naturally and reversely when viewed from above the front bed section with respect to the rear bed section.

1 Claim, 28 Drawing Sheets

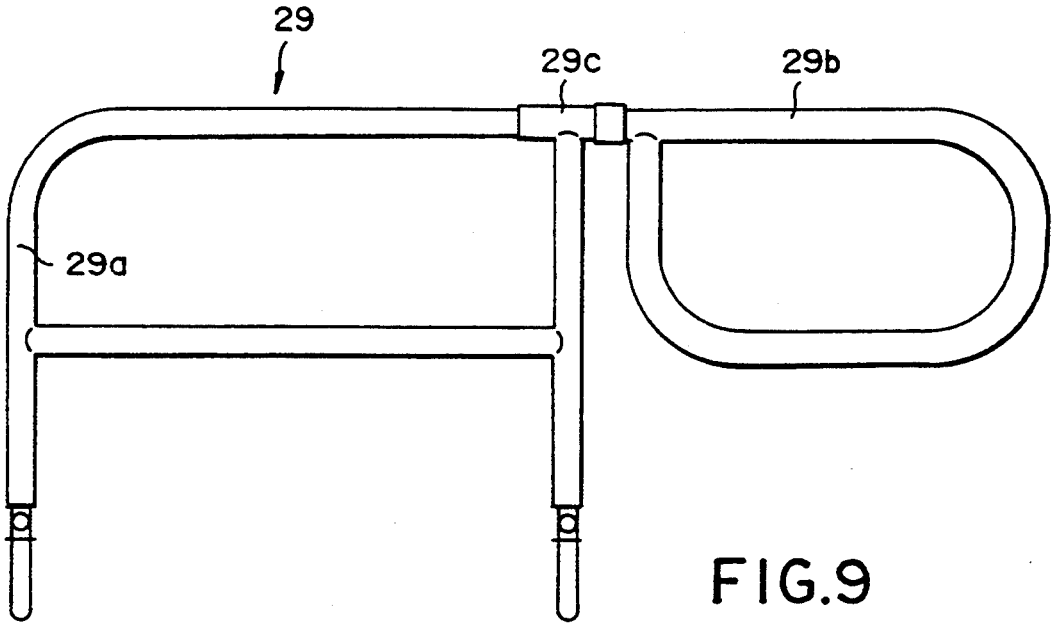
FIG.9
FIG.11
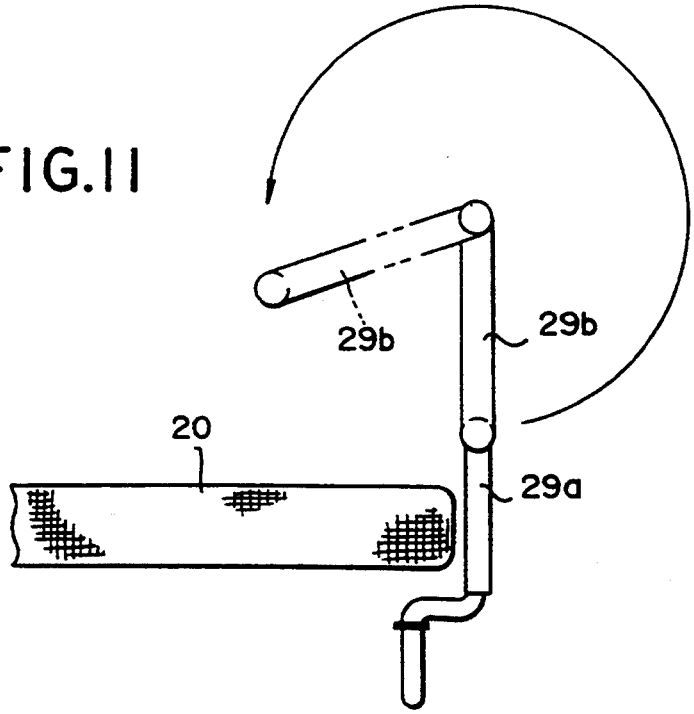

ROTARY, INVALID BED

This application is a continuation of application Ser. No. 08/181,083 filed Jan. 13, 1994 now abandoned, which is a division of Ser. No. 07/651,371, filed Dec. 26, 1991, now abandoned, and refiled as Ser. No. 08/307,100.

FIELD OF THE INVENTION

The present invention relates to a bed suitable for use by a physically handicapped person or a physically disabled aged person.

BACKGROUND ART

As a bed used by a physically disabled person, a bed is available in which a part thereof supporting the upper half of a body is pivotally provided to be moved upward and downward and the upper half of the body can be raised from a condition where the person is lying down to a condition where the person is able to sit up and eat a meal or read a book.

Also, there are beds which are used for medical treatment and have a completely different purpose from the present invention, such as used for the medical treatment of the spinal cord as disclosed in Japanese Patent Publication No. 1977/27472 and Japanese Patent No. 86424 published Jan. 27, 1930. The bed for medical treatment disclosed in the above-described Japanese Patent Publication No. 1977/27472 is designed to treat an unusual spinal cord in such a manner to change the posture of a body by pivoting somewhat rightward and leftward, moving somewhat forward and backward, or slightly twisting the foot of the bed. Also, the bed for medical treatment described in Japanese Patent No. 86424 is similarly designed to pivot the foot of the bed rightward and leftward.

Accordingly, either one of the beds is used for spinal cord treatment in such a manner that the upper half of the bed is fixed, while the lower half of the bed is moved to cure a deformation of the spinal cord.

In prior art beds, however, it has been very difficult for a physically handicapped person or a physically disabled aged person to turn 90 degrees by one-self and then assume a posture such that the person's feet are positioned above the floor to get out of bed without being helped or carried by a nurse.

The purpose of the present invention is to provide a bed capable of easily changing the posture of a physically handicapped person or a physically disabled aged person from a posture of lying on the back to a posture convenient to get out of the bed or to be helped by a nurse.

DISCLOSURE OF THE INVENTION

The present invention is arranged in such a manner that a bed is divided into a front bed section 20*a* for receiving the upper half of the body at least above the femur and a rear bed section 20*b* for receiving the lower half of the body under the leg; the shape of the divided part between both bed sections when viewed from above is formed as a convex circular arc from the center of the front bed section 20*a*; and a pivoting mechanism is provided between a fixed frame 1 and a pivoting frame 6 in a manner to pivot the convex circular arc part of the front bed section 20*a* with respect to the fixed rear bed section 20*b* from a condition that the section is moved forward and backward from a straight position to a condition that the section is moved in the direction of either rightward or leftward into an L hook-shaped position and stopped.

The arrangement allows the posture of a body to be easily changed such that, when a physically handicapped person or an aged person gets out of bed, held by a nurse, or carried on the person's back, the pivoting mechanism is driven to pivot the front bed section 20*a* 90 degrees with respect to the rear bed section 20*b* into an L hook-shaped position, thereby easily changing a posture convenient for the feet to slide on the surface of the fixed rear bed section 20*b* and get out of the bed, or to a posture convenient to be held by a nurse or carried on the person's back.

Also, in the present invention, a bed is divided into a front bed section 20*a* for receiving the upper half of the body at least above the femur and a rear bed section 20*b* for receiving the lower half of the body under the leg, a supporting frame 21 of the front bed section 20*a* is divided into a waist supporting frame 21*a* and a back supporting frame 21*b*, and the free end of the waist supporting frame 21*a* is pivotably provided to be moved upward so that a femur supporting part on the waist supporting side of the front bed section 20*a* can be swung upward to a higher position; a pivoting mechanism is provided between a fixed frame 1 and a pivoting frame 6 in a manner to pivot the front bed section 20*a* from a condition that the section is moved forward and backward with respect to the fixed rear bed section 20*b* to a condition that the section is moved in the direction of either rightward or leftward and stopped; and an actuating mechanism is provided for upwardly moving the free end of the waist supporting frame 21*a* so as to upwardly move at least the femur supporting part of the front bed section 20*a* when the pivoting frame is pivoted by the drive force of the pivoting mechanism.

The arrangement allows a smooth pivoting to be performed such that, when the feet slide on the surface of the fixed rear bed section 20*b* during pivoting of the front bed section 20*a*, by raising the femur supporting part of the front bed section 20*a*, the section can be pivoted without difficulty in a condition that only the feet slide on the top surface of the fixed rear bed section 20*b* in a knee upward bending posture.

In this case, if a bending mechanism for standing up the back supporting frame 21*b* is provided, the pivoting becomes more effective because a condition that a person using the bed raises the upper half of the body thereof can be obtained when the pivoting frame is pivoted by the drive force of the pivoting mechanism.

Also, in the present invention, divided right and left end parts of both bed sections are provided in a straight line when viewed from above, and a collision preventive mechanism S is provided for separating upward and downward the front bed section 20*a* from the rear bed section 20*b* when the front bed section 20*a* is pivoted so as to prevent the ends facing both bed sections from colliding with each other, whereby an effect can be obtained such that the divided parts need not have a special shape such as a circular arc, and a sheet covered on the bed can be easily turned down and stretched under the bed so that no extra wrinkle develops on the sheet.

Further, handrails for a bed according to the present invention are such that the rear parts of the handrails can be set toward the inside of the bed, so that a user, when descending to the floor, can easily get down and stand while gripping the displaced handrails near the user's sides.

BRIEF DESCRIPTION OF THE DRAWINGS

FIG. 9 is a side view of a handrail;

FIG. 11 is a front view of a principal part showing the pivoting of the handrail;

DESCRIPTION OF THE PREFERRED EMBODIMENTS

Figure 1:
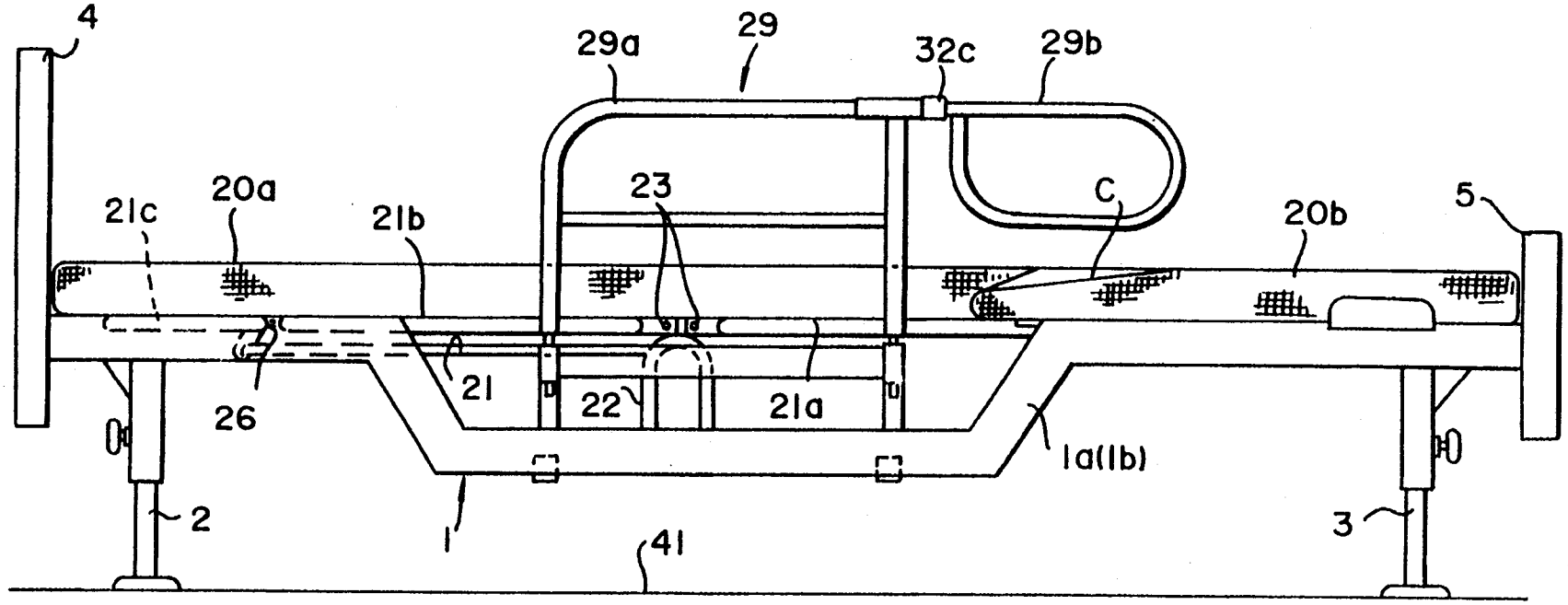
FIG. 1 is a side view of the whole of a bed.
Figure 2:
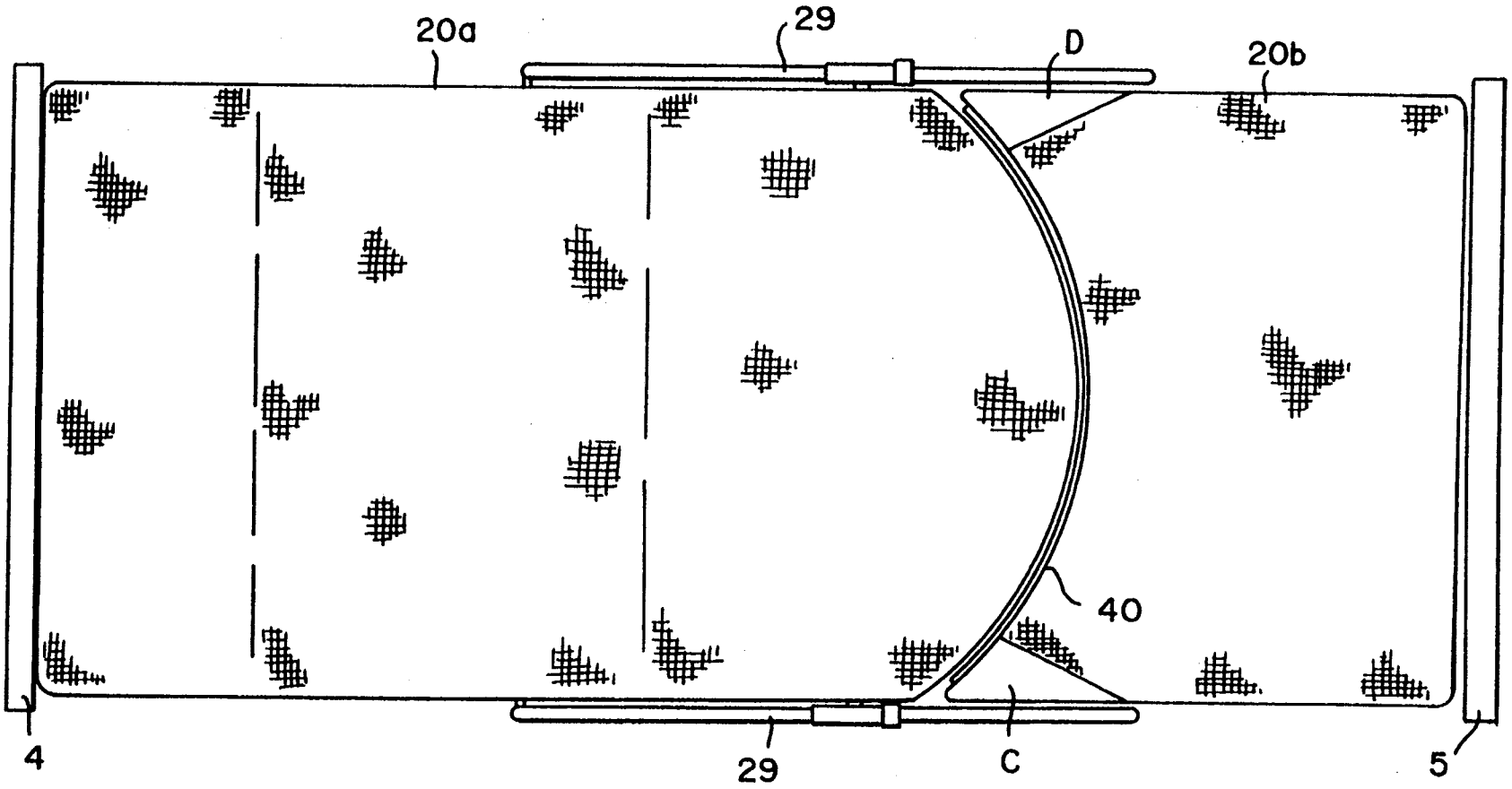
FIG. 2 is a plan view of the whole of a bed.
Figure 4:
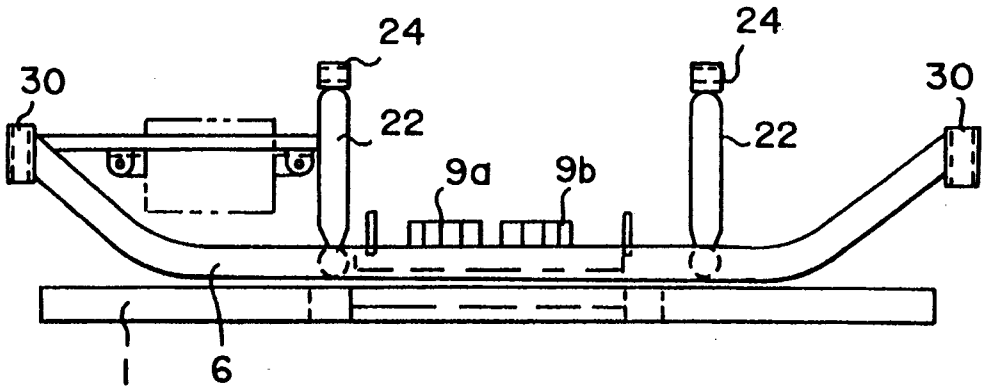
FIG. 4 is a side view of FIG. 3.
Figure 3:
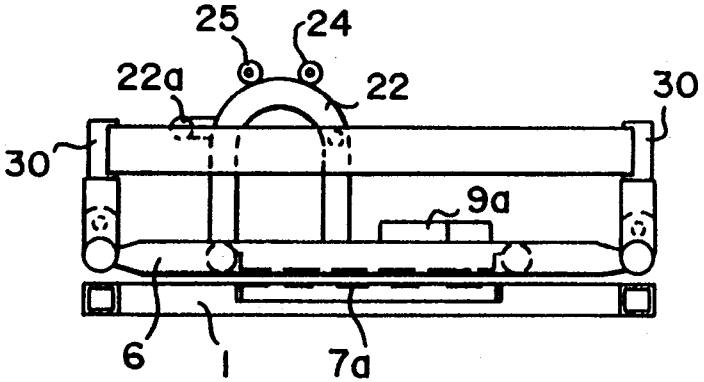
FIG. 3 is a side view of a pivoting frame.
Figure 5:
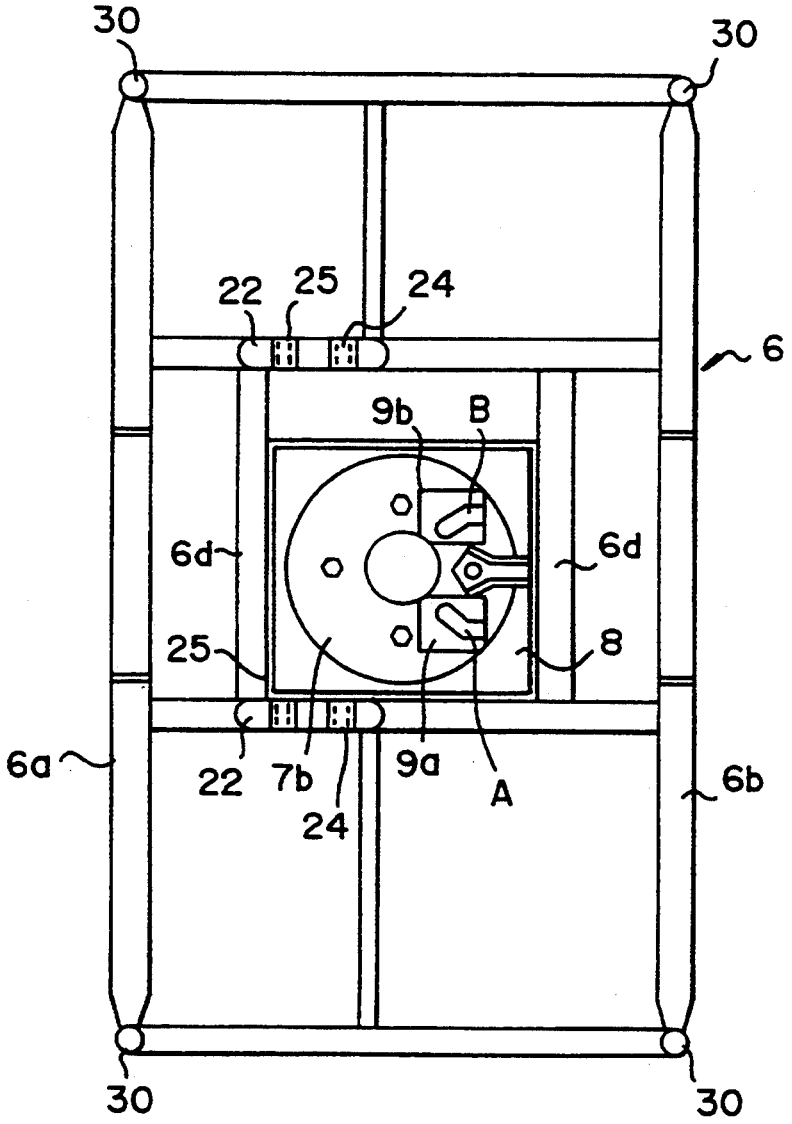
FIG. 5 is a plan view of FIG. 4.

Based on the drawings showing embodiments according to the present invention, an explanation will be given hereinafter. In the drawings, a fixed frame 1 of a bed is supported by a front foot 2 and a rear foot 3. The middle part of the frame in the forward-backward (straight line) direction is concave downward when viewed from a side. A right side frame 1*a* and a left side frame 1*b* are properly connected by joining frames 1*c* when viewed from above. Numerals 4 and 5 indicate a front board and a rear board, respectively.

Figure 6:
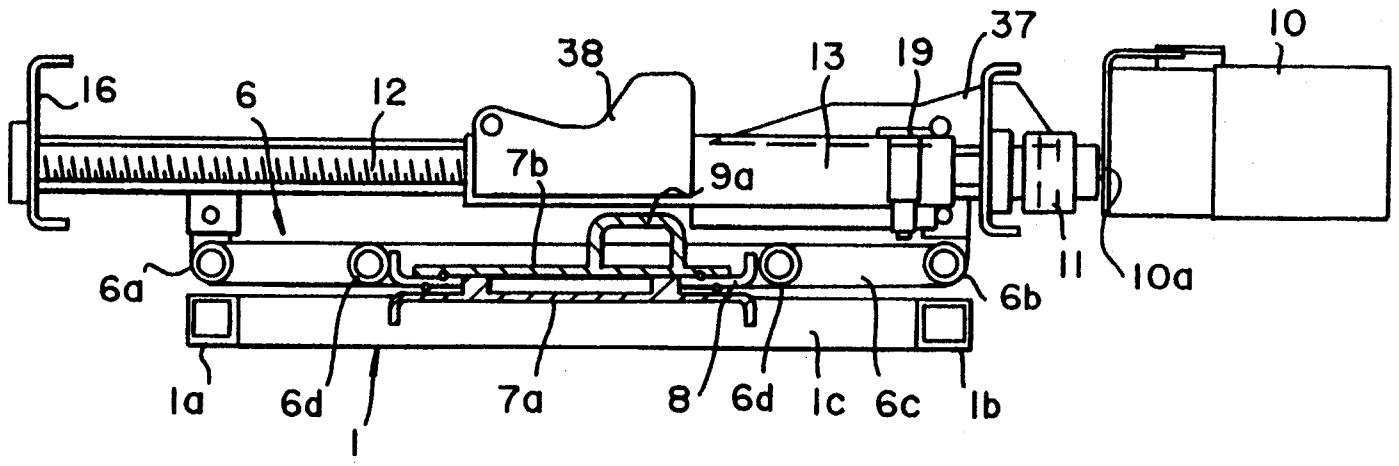
FIG. 6 is a side view of a principal part of an actuating mechanism for actuating the pivoting frame.

A pivoting frame 6 of the bed is fixed to a pivoting plate 8. The pivoting plate 8 is pivotally provided by being supported upward and downward with bearings in a clearance between *a*) a lower fixed ring 7*a*, which is fixed to the joining frame 1*c* located on the concave part of the middle part of the fixed frame 1, and *b*) an upper fixed ring 7*b* which is integrally fixed to the lower fixed ring 7*a*. The pivoting frame 6 also comprises side frames 6*a* and 6*b* which stretch in the forward-backward direction on the right and left side, a tie frame 6*c* (see FIGS. 6 and 7) which is connected to the pivoting plate 8, and a mounting frame 6*d* which is connected to the tie frame 6*c*.

The pivoting mechanism of the pivoting frame 6 will be explained hereinafter. First, fixed cams 9*a* and 9*b* are fixedly secured on the fixed ring 7*b*. The cams extend on the right and left side on the upper surface of the ring. The cams are provided with cam grooves A and B displaced toward the center in the backward-to-forward direction.

The pivoting frame 6 is provided with a transmission mounting frame 16 which is integrally fixed to the frame 6 and formed in a rectangular shape when viewed from above. On the frame 16, a motor 10 is mounted in such a manner that the direction of a drive output shaft 10*a* is in the forward-backward direction (straight line direction). A screw shaft 12 is, in the forward-backward direction, connected through a friction transmission joint 11 serving also as a shock release to the shaft 10*a*. The screw shaft 12 is pivotally beared by the transmission mounting frame 16. A screw cylinder 13 is threadly engaged with the screw shaft 12. Shafts 14 and 15, as a mechanism for stopping the rotation of the screw cylinder 13, are provided on the right and left side of the cylinder. To the shafts, rollers 17 are mounted which abut and are rollingly moved on the right and left frames 16*a* and 16*b* of the frame 16.

A lateral frame 18 has holes 18*a* and 18*b* on the right and left side for inserting or removing cam pins 19. The pins 19 are arranged such that, when the pin 19 is inserted into the right hole 18*a* or the left hole 18*b* of the lateral frame 18 and the motor 10 is rotated to move the screw cylinder 13 forward, the lower end of the pin 19 is fitted into the cam groove A of the cam 9*a* or the cam groove B of the cam 9*b* in a manner to pivot, with the motor 10 through the transmission mounting frame 16, the pivoting frame 6 rightward or leftward. Also, the pins are arranged such that, when the motor 10 is reversely rotated to move the screw cylinder 13 backward, the cam action at the time when the pin 19 slides out from the cam groove A or B causes the pivoting frame 6 to be pivoted reversely to the above motion and to be reset. Although the pivoting angle of the pivoting frame 6 varies with the displaced angle and length of the cam grooves A and B, in the present invention, when the pivoting frame pivots substantially 90 degrees, the friction transmission joint 11 acts to stop the frame.

The front bed supporting frame 21, for supporting the front bed section 20*a* which receives the upper half of the body above the femur on the pivoting frame 6, is provided with brackets 24 and 25 for fixing the waist supporting frame 21*a* and the back supporting frame 21*b*, respectively, with pins 23 to projection frames 22 projected in reverse U-shape from the pivot frame 6. The bases of the supporting frames 21*a* and 21*b* are pivotally secured. The pivoting tops thereof are properly supported by the pivoting frame 6 in a manner to become substantially horizontal. Also, the top of the back supporting frame 21*b* is provided with a head supporting frame 21*c* pivotally secured with a pin 26 on the frame 21*c*. The head supporting frame 21*c* is arranged such that the frame 21*c* is connected through links 27 to the projection frames 22 to keep only the head supporting frame 21*c* in a horizontal posture when the back supporting frame 21*b* is pivoted upward. When the base of a rod 27*a* of the link 27 is connected to a bracket 28, which is fixedly secured on the back supporting frame 21*b*, the head supporting frame 21*c* is pivoted with the back supporting frame 21*b* without pivoting horizontally, whereby posture change-over means for changing the mounting of the rod 27*a* is changed.

Cylinders 30 for inserting and removing the handrail 29 are provided on the four corners of the pivoting frame 6. The handrail 29 comprises a gate-shape fixed handrail 29*a* which is inserted into the cylinders 30 and fixed thereto. A pivoting handrail 29*b* is pivotally inserted in the forward-backward direction into bosses 29*c* formed integrally with the rear upper end of the handrail 29*a* and is then mounted with a screw 31 and a slip-out preventive groove 32*a* cut on an insertion shaft 32. The pivoting handrail 29*b* is formed in a substantially elliptical loop with a pipe, and arranged such that the position of the handrail 29*b* is changed over to a position at which the handrail hangs down or to a position at which the handrail is stopped diagonally somewhat downward by means of pivoting stopper 29*d* and 32*b* provided on the boss 29*c* and the pivoting handrail 29*b* at the end face of the insertion shaft 32, respectively. Numeral 32*c* indicated a cover of the stoppers.

The front bed section 20*a*, which is a mat for a normal bendable bed, is placed on the upper surface of the front bed supporting frame 21 provided as described above on the pivoting frame 6, and the rear end of the front bed section 20*a* is formed in a circular arc from the pivoting center of the pivoting frame 6 as a center.

The rear bed section 20*b* is placed on the upper surface on the rear side of the fixed frame 1. The front end face is formed in a circular arc from the pivoting center of the pivoting frame 6 as a center. Projections C and D on the right and left sides of the bed 20*b*, which have a concave shape when viewed from above, are inclined in such a manner that the closer they are to both edges, the thinner they become.

Figure 18:
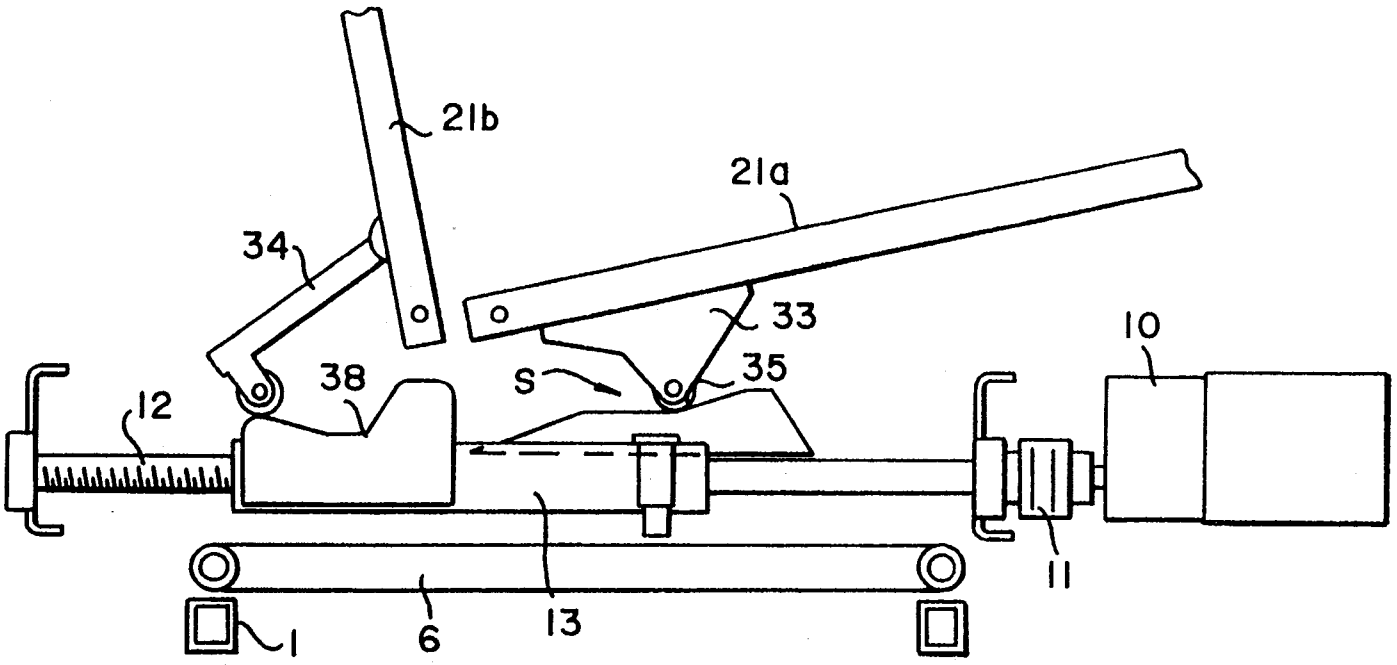

The pivoting mechanism of the waist supporting frame 21*a* and the back supporting frame 21*b*, which are pivotally mounted through the projection frames 22 on the pivoting frame 6, will be explained hereinafter. On the underside of the supporting frames 21*a* and 21*b*, cam rollers 35 and 36 through brackets 33 and 34 are rollingly provided through laterally mounted shafts. A cam 37, abutting on the cam roller 35, is fixedly secured on the right side of the lateral frame with the screw cylinder 13. A cam 38 abutting on the cam roller 36 is fixedly secured on the left side of the screw cylinder 13. When the screw shaft 12 is rotated by the motor 10 to move the screw cylinder 13 forward, the cam roller 36 is pushed by the front end vertical face of the cam 38 to cause the back supporting frame 21*b* to be gradually pivoted backward. Substantially at the same time, the cam roller 35 is gradually pushed up by the cam 37 to cause the rear side of the waist supporting frame 21*a* to be pivoted somewhat upward. Then, somewhat prior to the condition as shown in FIG. 18, the cam pin 19, having been inserted into the hole 18*a* or 18*b* on the one side of the lateral frame 18, is fitted into the cam groove A or B of the fixed cam 9*a* or 9*b* located on the pin 19 side. Thereafter when the screw cylinder 13 moves forward and the pin 19 approaches the bias of the cam groove, the pivoting frame 6 begins to pivot rightward or leftward. Then, when the frame 6 pivots substantially 45 degrees, the back supporting frame 21*b* lowers in a manner to become gentle in inclination and at the same time the waist supporting frame 21*a* becomes gradually sharp in inclination while the pivoting frame 6 further pivots. Thereafter, when the pivoting frame 6 assumes a final pivoting posture in which the frame pivots substantially 90 degrees, the back supporting frame 21*b* side is positioned in a vertical condition and the waist supporting frame 21*a* returns to a horizontal condition. In such manner as described above, the relative position of each cam to pin or cam roller, and the shape of the cam has been set.

A switch box 39 is provided in such a manner that a disabled person or an aged person on the bed, or a nurse can freely operate the motor 10 from any position by a cord connected to the switch box. The switch box is arranged such that the motor can be freely rotated naturally or reversely by change-over of the switch, whereby the rotation direction of the screw shaft 12 is changed to cause the screw cylinder 13 to be moved forward or backward.

A slide member 40 is made of leather or synthetic rubber and provided on one end face or both end faces between the convex circular arc end face of the upper half of the body supporting bed section 20*a* and the concave circular arc end face of the lower half of the body supporting bed section 20*b*. The slide member smooths the pivoting of both end faces.

The operation of the above example will be explained in detail hereinafter.

Figure 7:
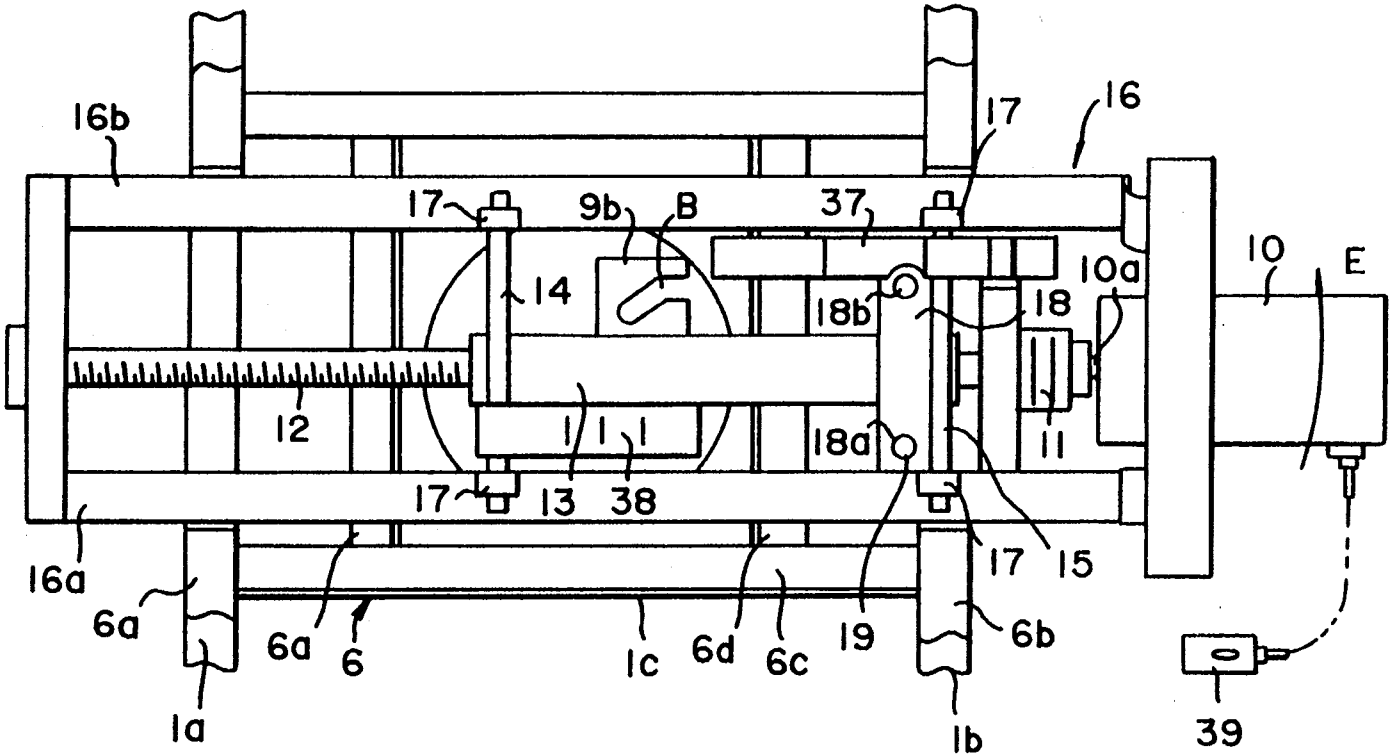
FIG. 7 is a plan view of the principal part.
Figure 8:
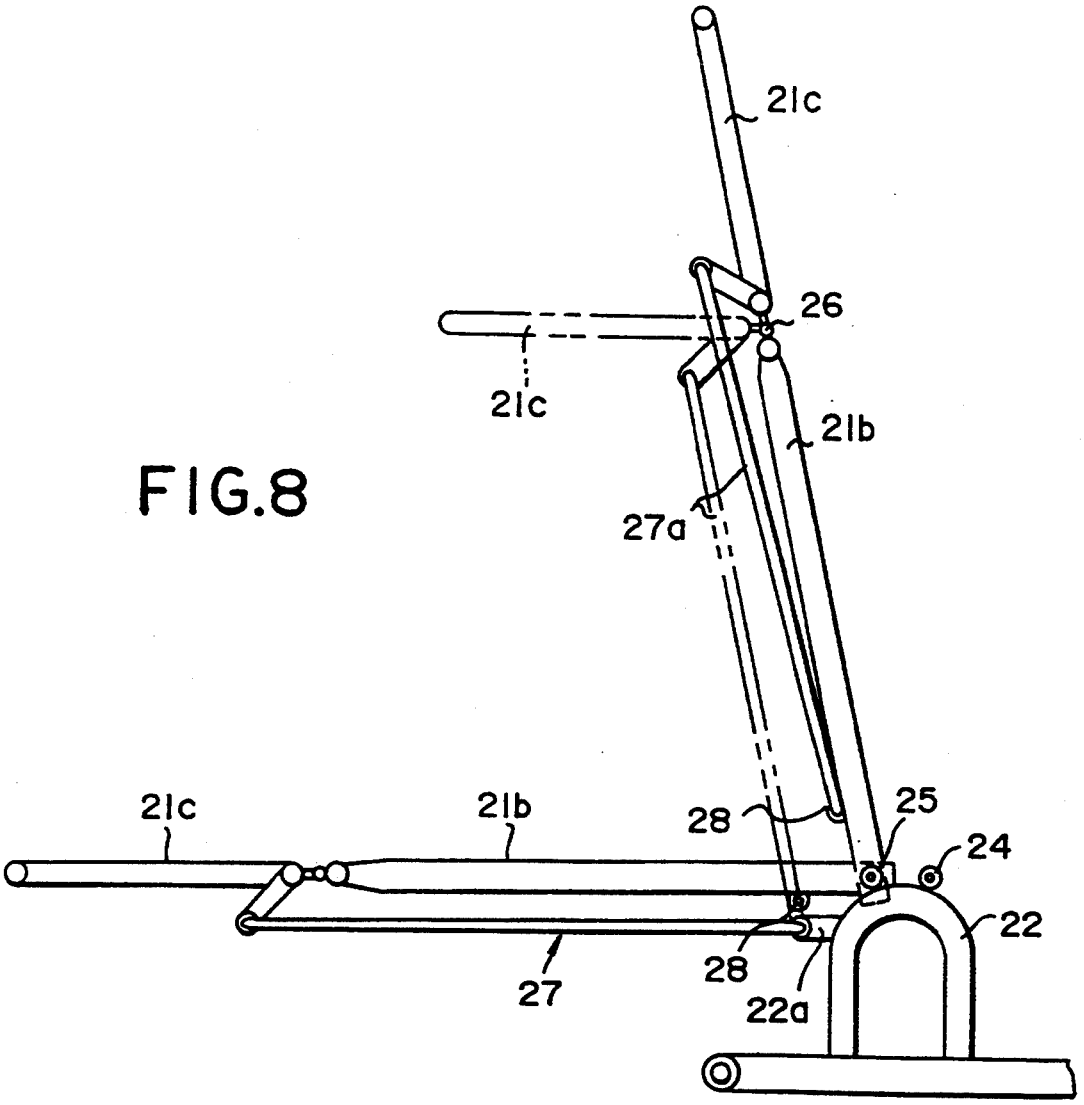
FIG. 8 is a principal part showing a condition of the mounting of a back supporting frame.
Figure 10:
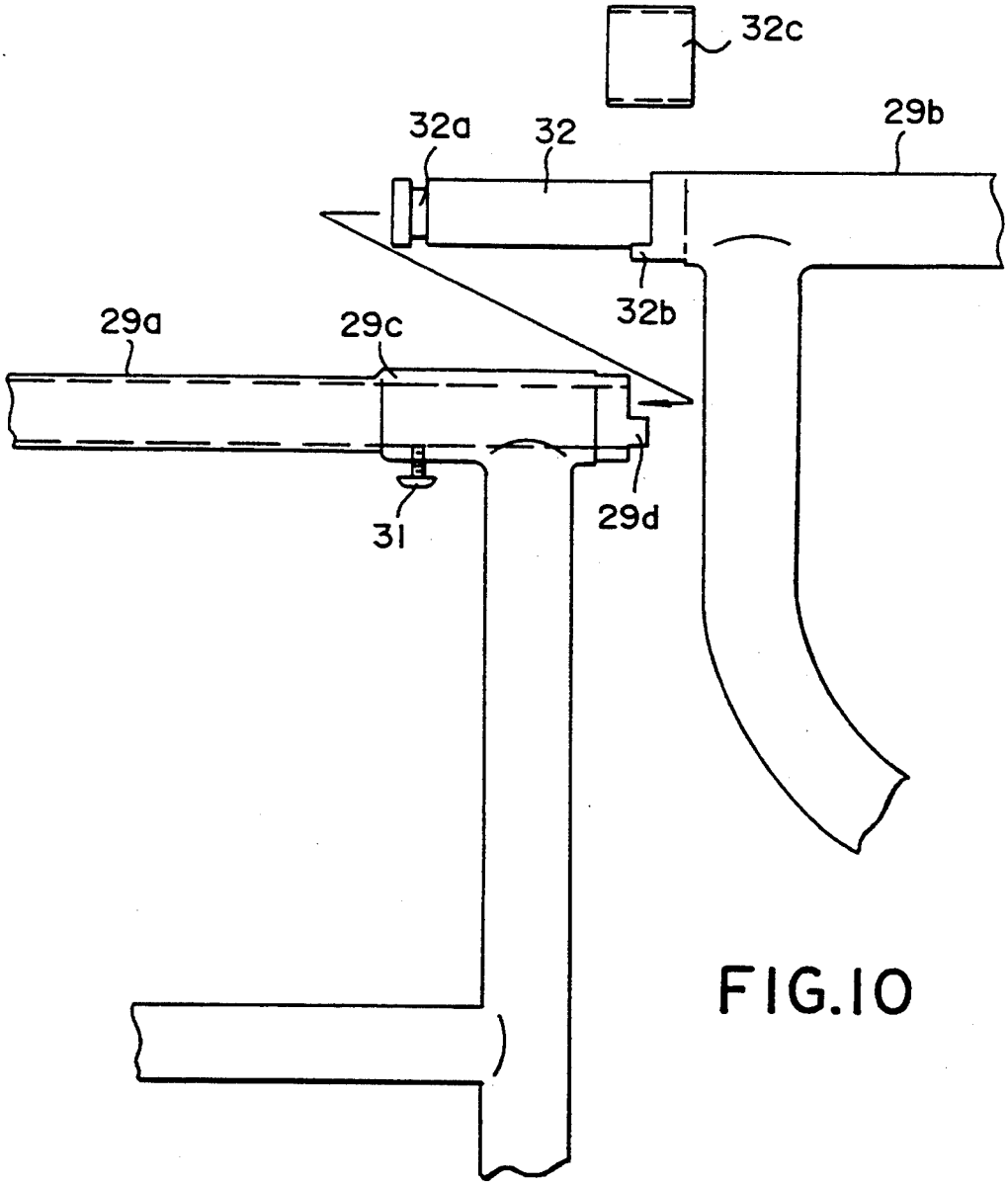
FIG. 10 is a side view showing a pivoting mechanism of the handrail.
Figure 12:
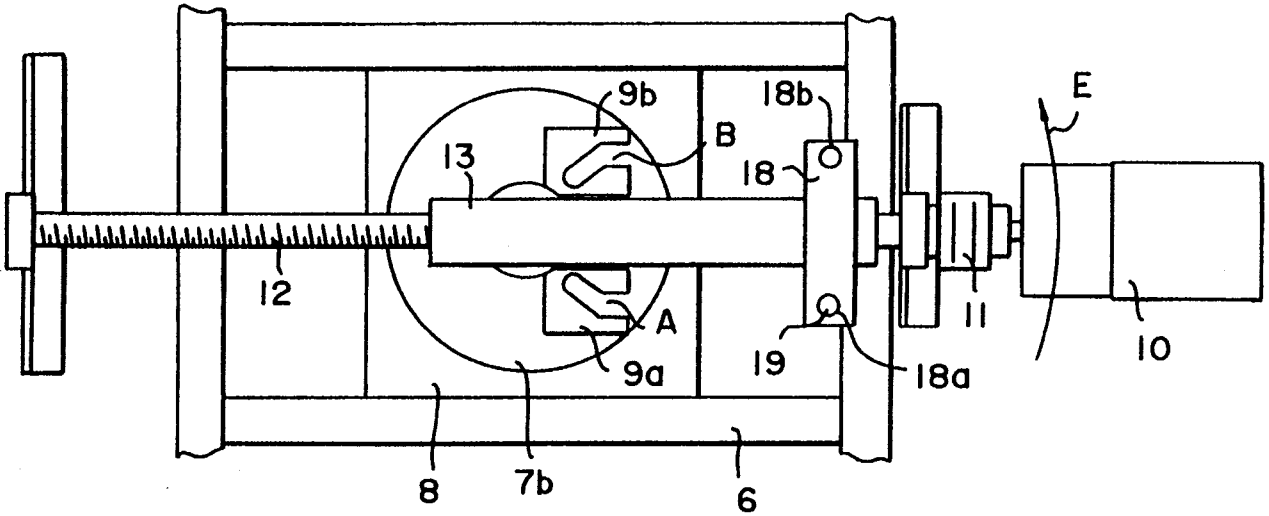
FIGS. 12, 13, 14 and 15 are plan views showing drawings of the pivoting process of the pivoting mechanism for the pivoting frame.
Figure 16:
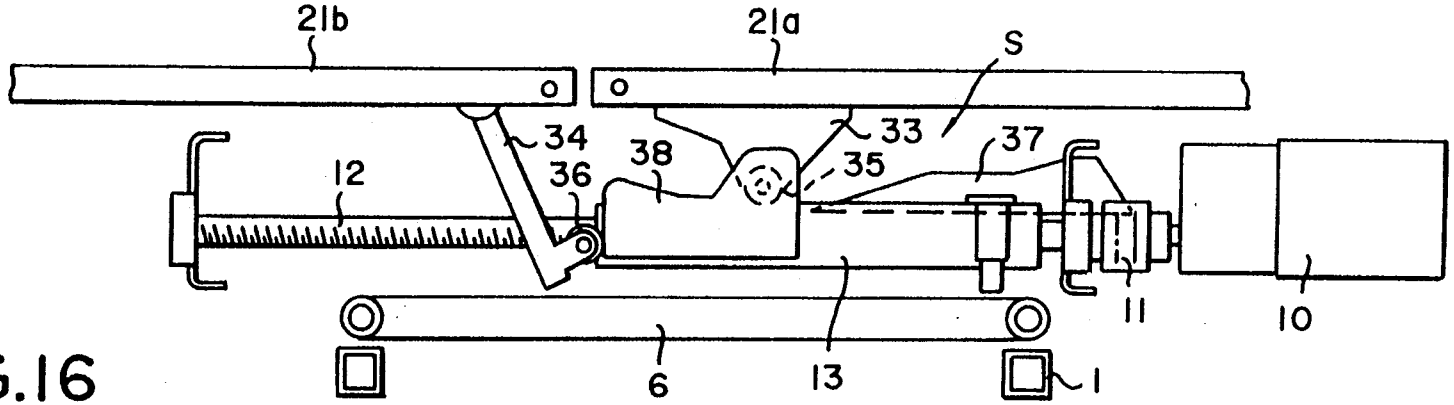
FIGS. 16, 17, 18, 19 and 20 are side views of a principal part showing the operation and the process of the bending actuation of a front bed section.
Figure 17:
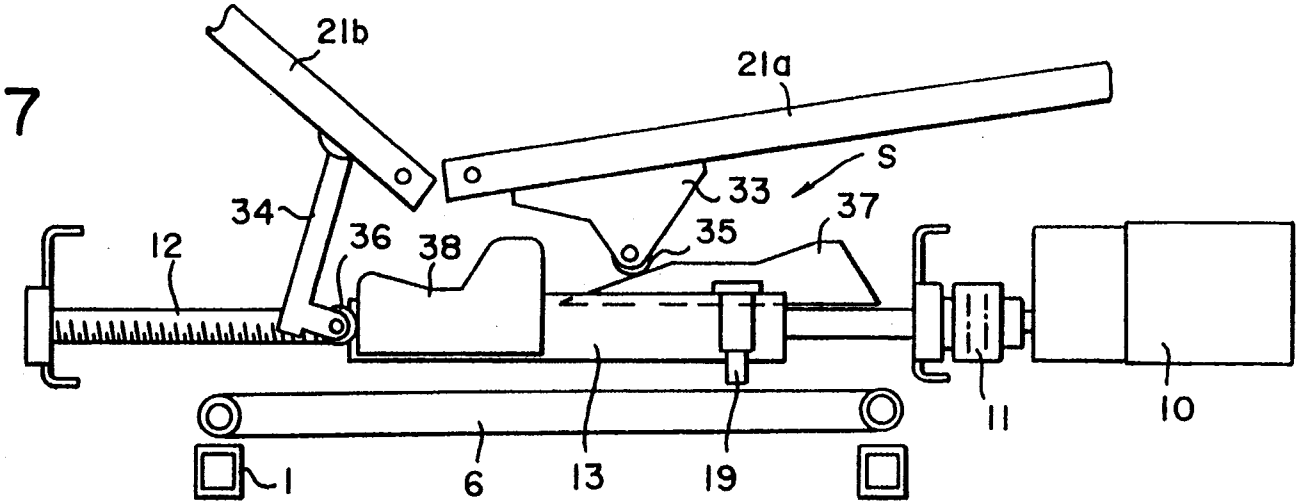
Figure 21:
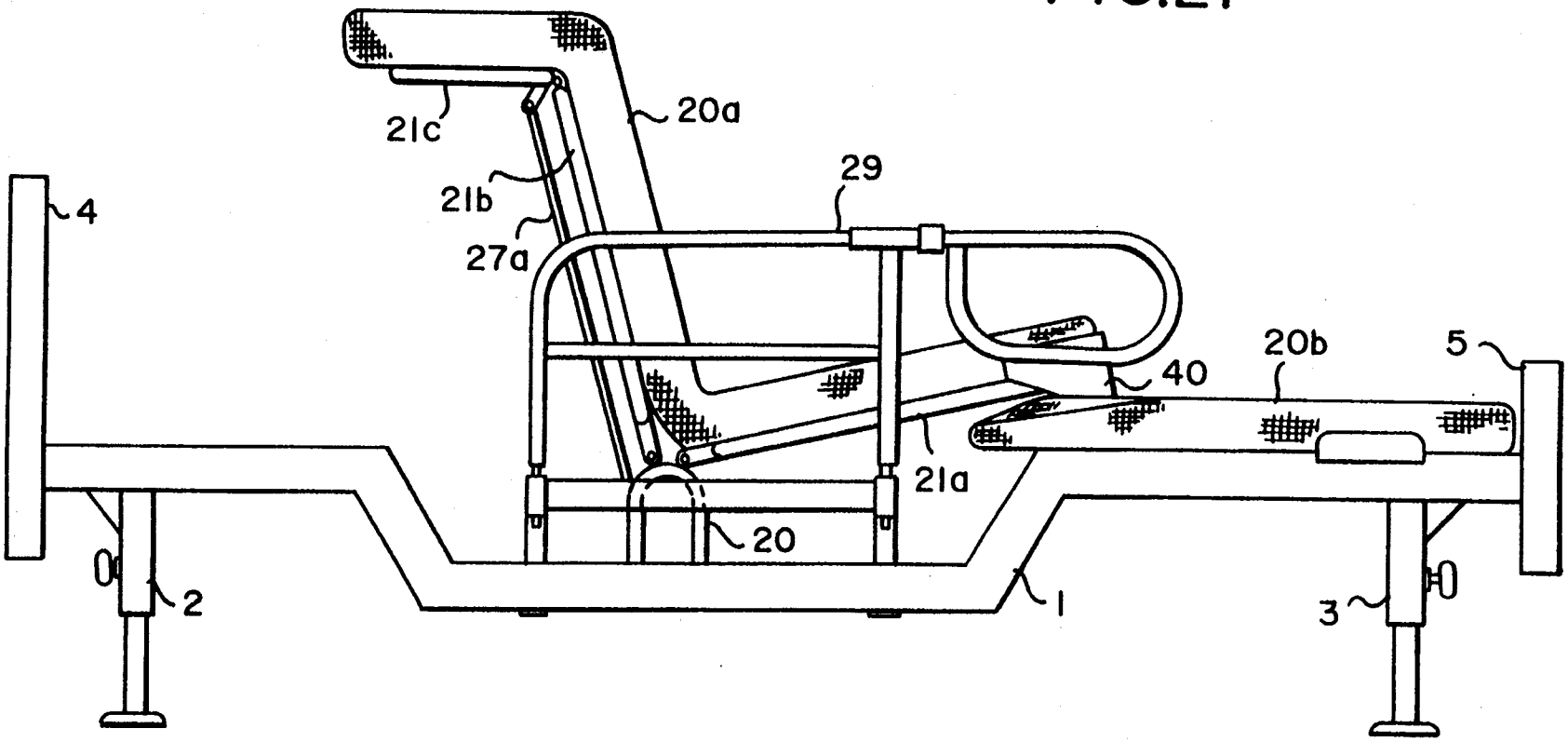
FIG. 21 is a side view showing the whole posture changed condition.
Figure 22:
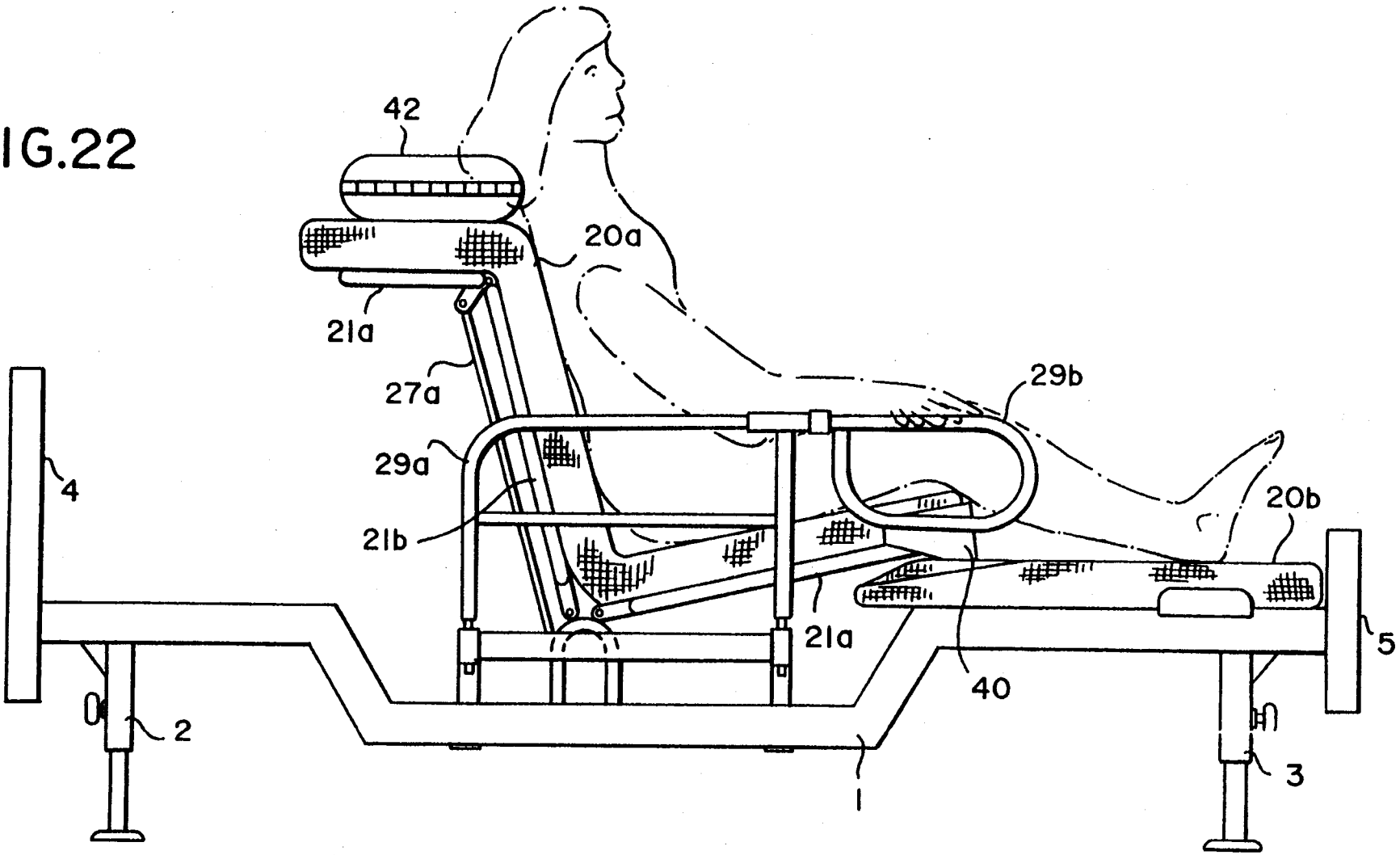
FIG. 22 is a side view showing a posture when a person on the bed is taking a meal or a condition at a time when pivoting is started.

A disabled person or an aged person is laid on the bed on the person's back with the upper half of the body after the waist supported by the front bed section 20*a* and with the legs supported by the rear bed section 20*b*. When such a person wants to change position from a posture in which the person is lying to a posture in which the person raised the upper half of the body thereof to take a meal, to a posture in which the person descends on the right side (left side with respect to the laid person) to the floor 41, or to a posture in which the person is held by a nurse or carried on the person's back, the cam pin 19 has previously been inserted into the left side hole 18*a* of the lateral frame 18 as shown in FIGS. 7 and 8, and then the screw shaft 12 is allowed to rotate rightward by the motor 10 to move the screw cylinder 13 forward. Then, the cam roller 35, which is mounted through the bracket 33 on the waist supporting frame 21*a*, is first pushed up by the cam 37. At the same time, the cam roller 36, which is mounted through the bracket 34 on the back supporting frame 21*b*, abuts on the front face of the cam 38 to pivot the supporting frames 21*a* and 21*b* as shown in the operation processes of FIGS. 16 through 18, whereby a posture in which the upper half of the body is raised to take a meal or read a book as shown in FIG. 21 and 22 is attained. However, if only the posture is desired, the cam pin 19 need not be inserted into the hole 18.

Figure 13:
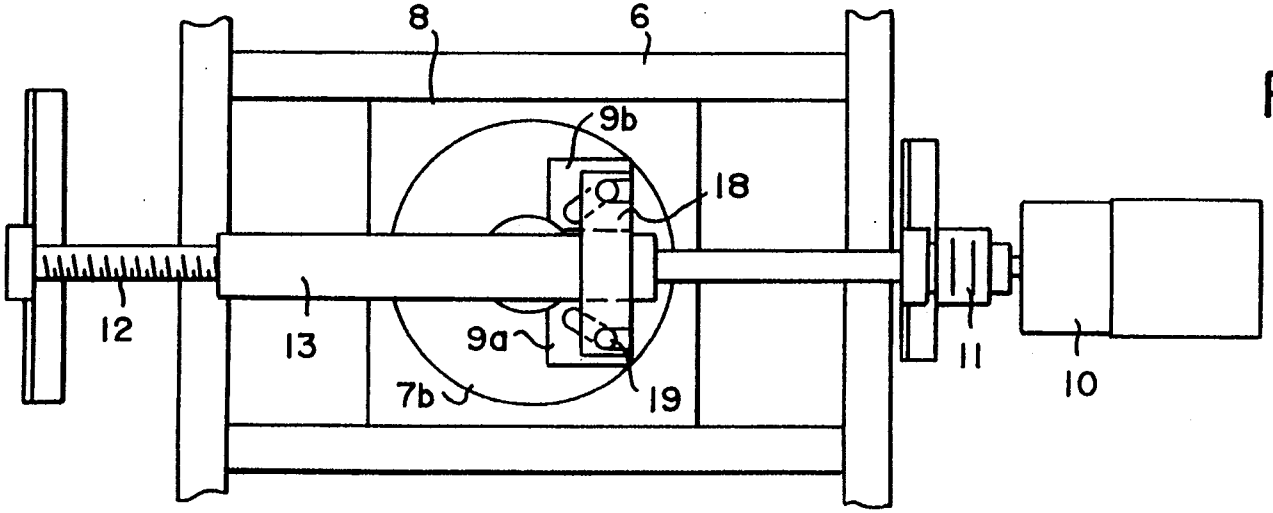
Figure 14:
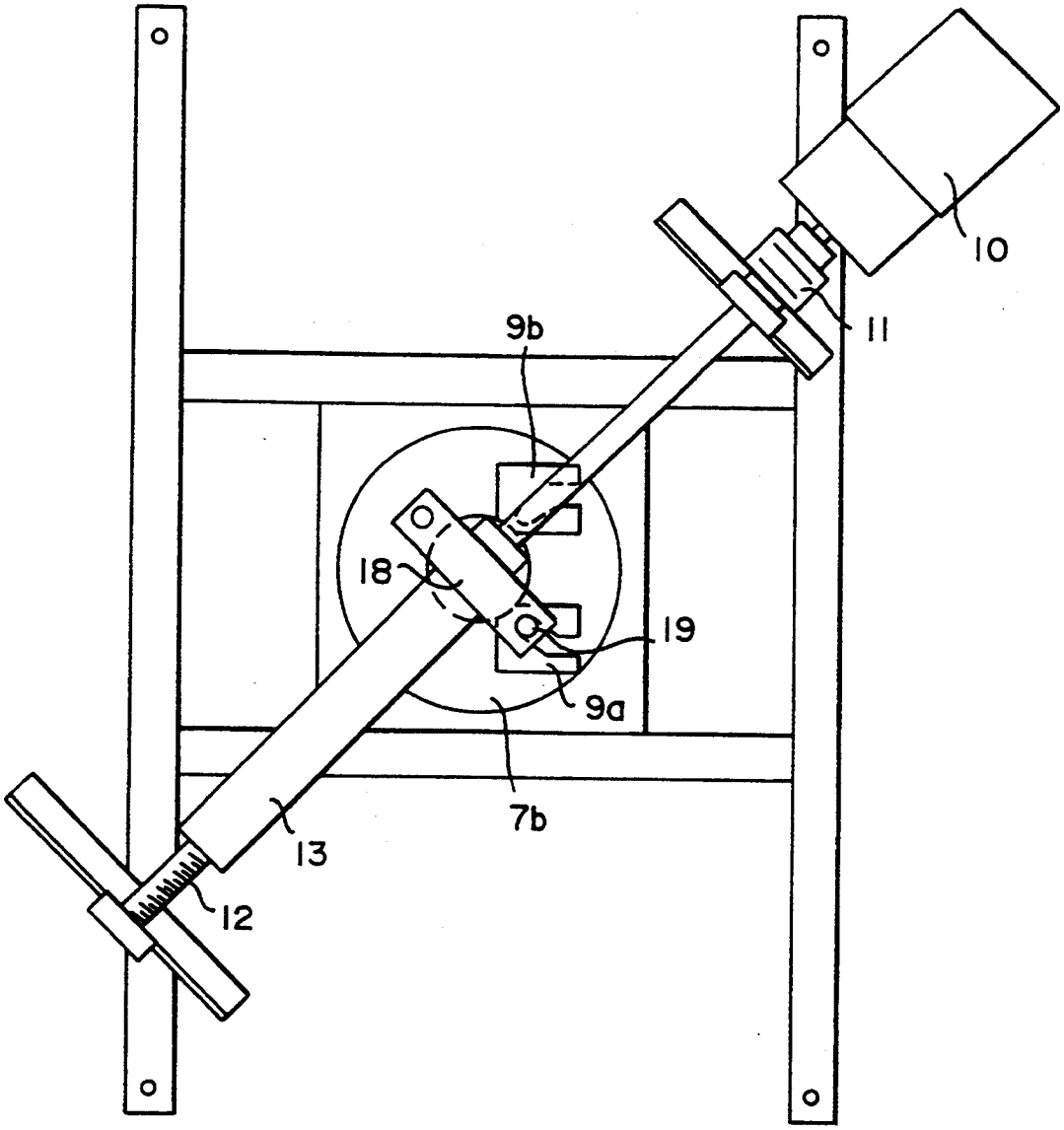
Figure 15:
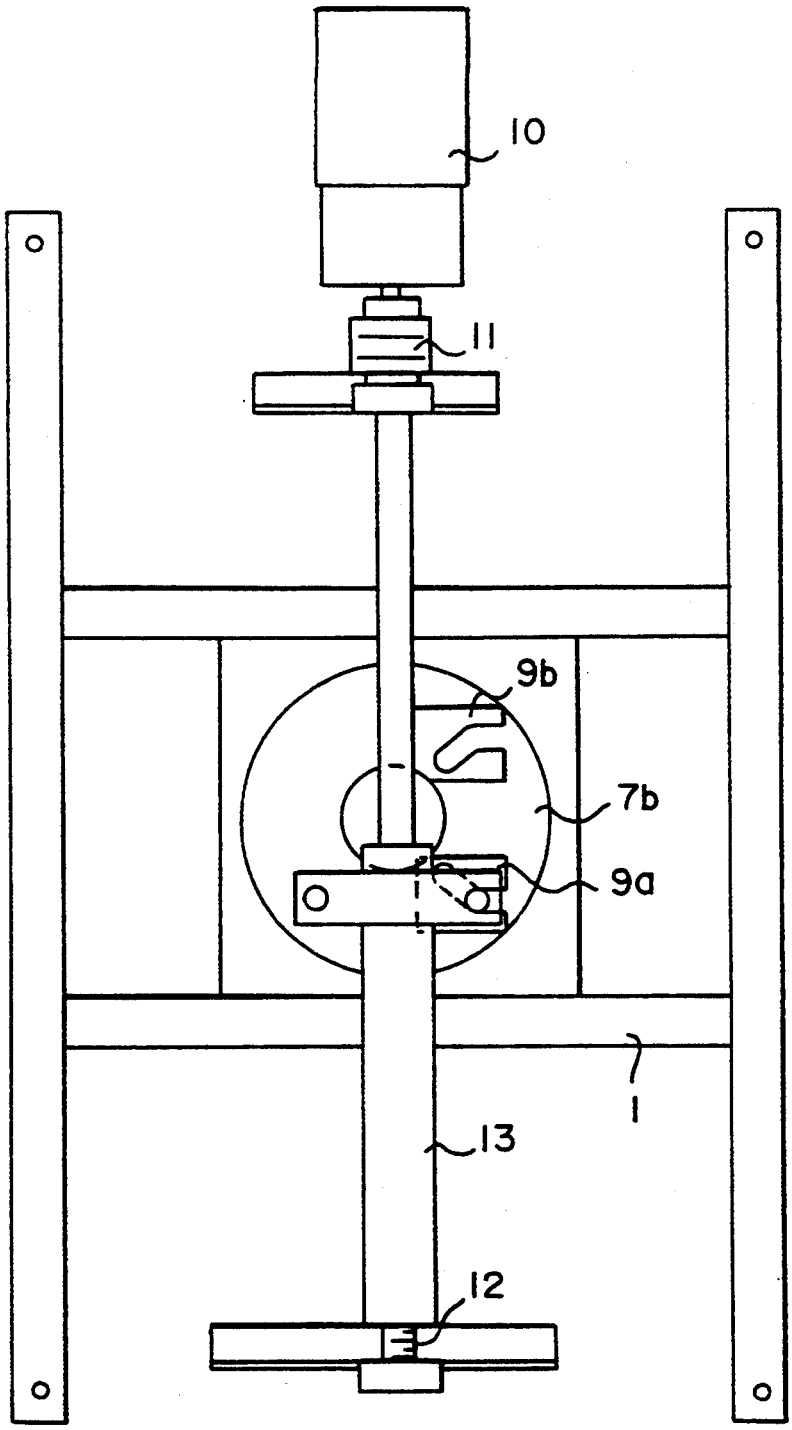

Then, when the motor 10 is further rotated from such a condition to move the screw cylinder 13 forward, the cam pin 19 abuts on the bias part in the cam groove A of the right fixed cam 9*a*, which is provided on the bed fixed frame 1, to pivot both the frame 16 which is provided with the motor 10 and the pivoting frame 6 being in a body with the frame 16 rightward (in the arrow E direction) with respect to the fixed frame 1 as shown in the conditions of FIG. 13 through FIG. 15. At the time when the condition of FIG. 14 in the course of pivoting is attained, the relative position of the cam rollers 35 and 36 to the cams 37 and 38 is in the condition of FIG. 18. When the screw cylinder 13 is further moved forward, the pivoting frame 6 and the drive including the motor 10 are pivoted substantially 45 degrees from the condition of FIG. 14 to that of FIG. 15, that is, about 90 degrees from the first condition. At the time when the final pivoting of about 45 degrees is performed, the relative position of the cam rollers 35 and 36 to the cams 37 and 38 is changed from the condition of FIG. 18 to that of FIG. 20. That is, the back supporting frame **21*b* pivots somewhat backward and at the same time the waist supporting frame 21*a* becomes somewhat higher. Thereafter, the back supporting frame 21*b* again stands and at the same time the waist supporting frame 21*a* becomes horizontal. That is, the laid person finally assumes through the condition of Fig. 22 the posture of FIG. 23**.

Figure 23:
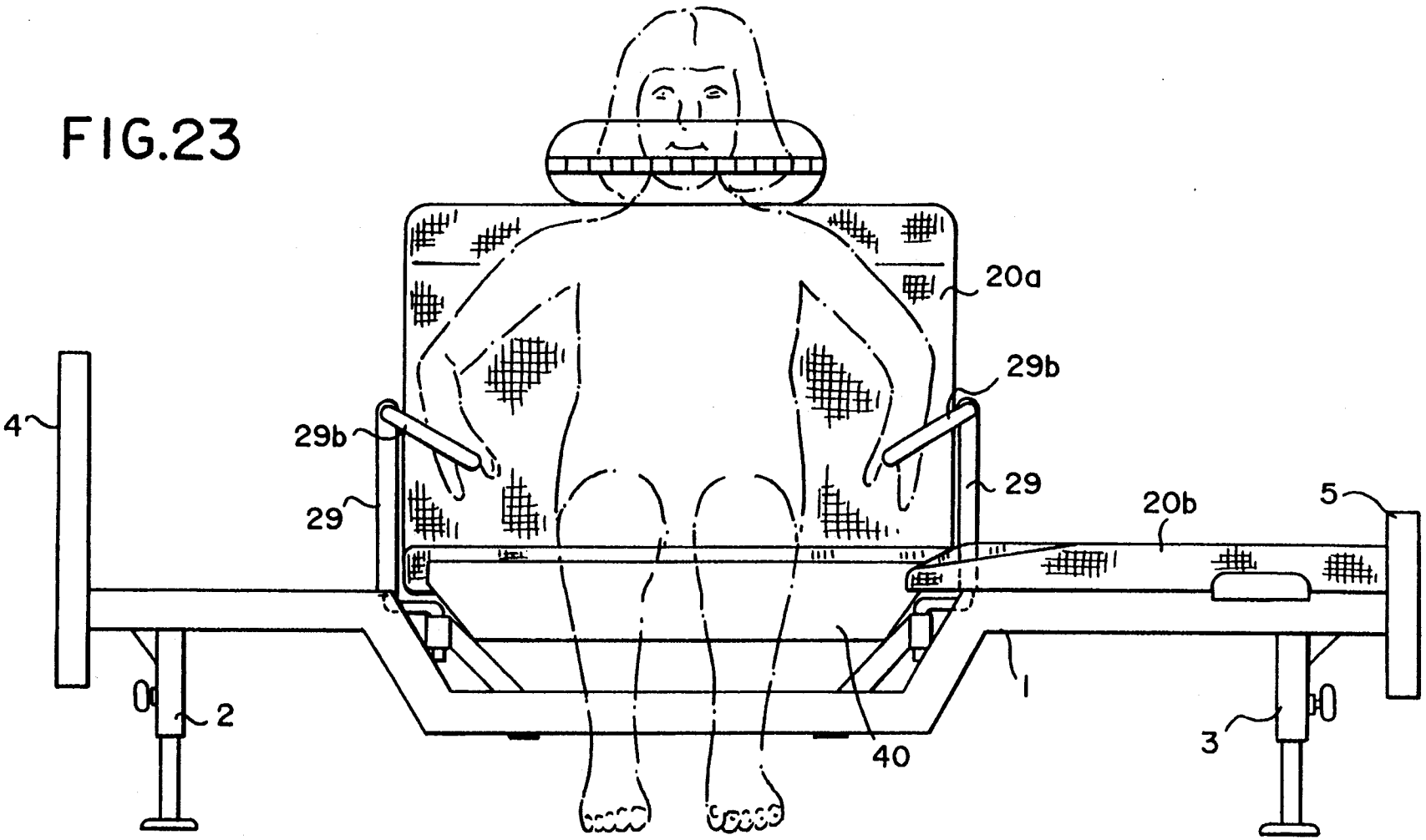
FIG. 23 is a side view showing a condition that the pivoting frame has completed pivoting thereof and then a person descends and stands on the floor, or a condition that a person is held by a nurse or carried on the person's back.

In order to return the posture of FIG. 23 to the original posture in which the bed is in the forward-backward direction (i.e., straight position), the motor 10 is allowed to rotate rightward (reverse to the above-described rotation), whereby an operation completely reverse to the above-described operation can be performed to return to the original lying posture. Further, in order to reversely pivot the pivoting frame 6 to reverse the comedown side to the left side , the cam pin 19 must be inserted into the other hole **18*b* to be fitted into the cam groove B of the right fixed cam 9*b***.

Figure 19:
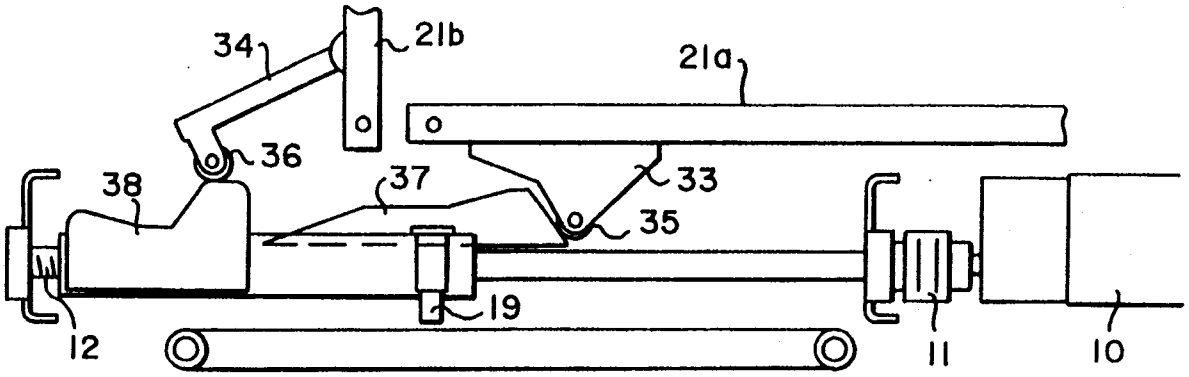
Figure 20:
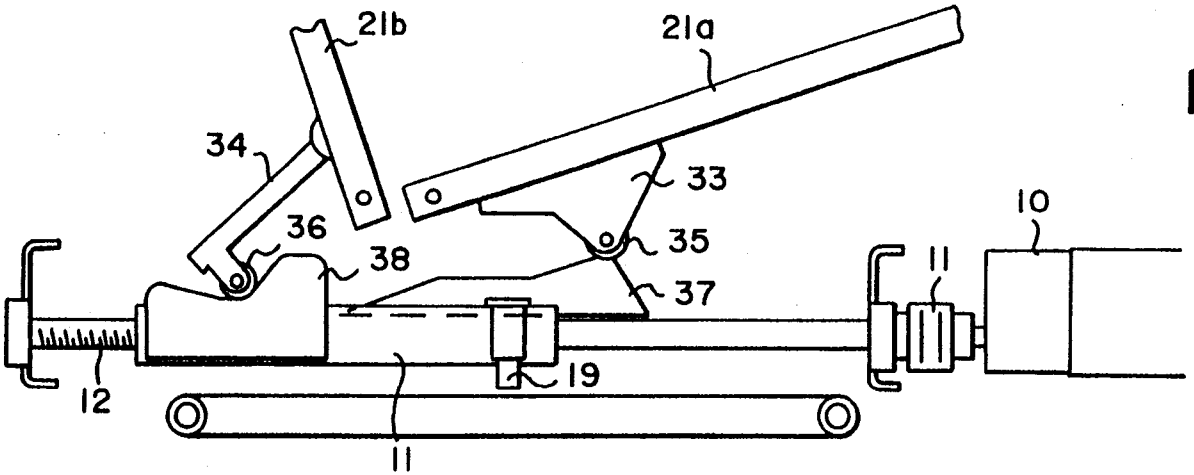

In the processes of the front bed section **20*a* operation as shown in FIG. 22 to 23, the waist supporting frame 21*a* and the back supporting frame 21*b* are operated in the conditions shown in FIG. 18 through 20 as described above, so that a person on the bed slightly upwardly swings the femur, which is supported by the top of the waist supporting frame 21*a*, to prevent the free end of the waist supporting frame 21*a* from pivoting while being wholly rubbed on the fixed rear bed section 20*b*, and to prevent the foot opposite to the pivoting direction from being caught by the fixed rear bed section 20*b* to cause foot twisting. At this time, swinging only the waist supporting frame 21*a* causes the person on the bed to be excessively bent and have a pain, so that, to prevent such a condition, an operation is performed such that the back supporting frame 21*b* is lowered somewhat backward, and thereafter stands up again at the same time when the waist supporting frame 21*a*** returns to a horizontal condition.

Accordingly, a lying person can finally be in the posture of FIG. 23 to be faced toward the side of the bed. When the person wants to descend to the floor 41 in that posture, by allowing the handrail **29*b* to pivot to the virtual line in FIG. 11 and to be in a posture of FIG. 23 in which the handrail is pivoted, the person can descend to the floor 41 while grasping the handrail 29*b*** without difficulty.

In order to prevent a pillow 42 or a book placed near the pillow from falling when the front bed section **20*a* is pivoted and bent, the base of the rod 27*a* of the link mechanism 27 is to be connected to the bracket 22*a* of the projection 22. When the back supporting frame 21*b* is pivoted upward, the head supporting frame 21*c* is kept at all times horizontal as shown by the virtual line in FIG. 8, so that the head side bed section is hardly changed as in the posture of FIG. 21 or 22, thereby preventing the pillow 42** or another object placed near the pillow from slipping off.

Figure 24:
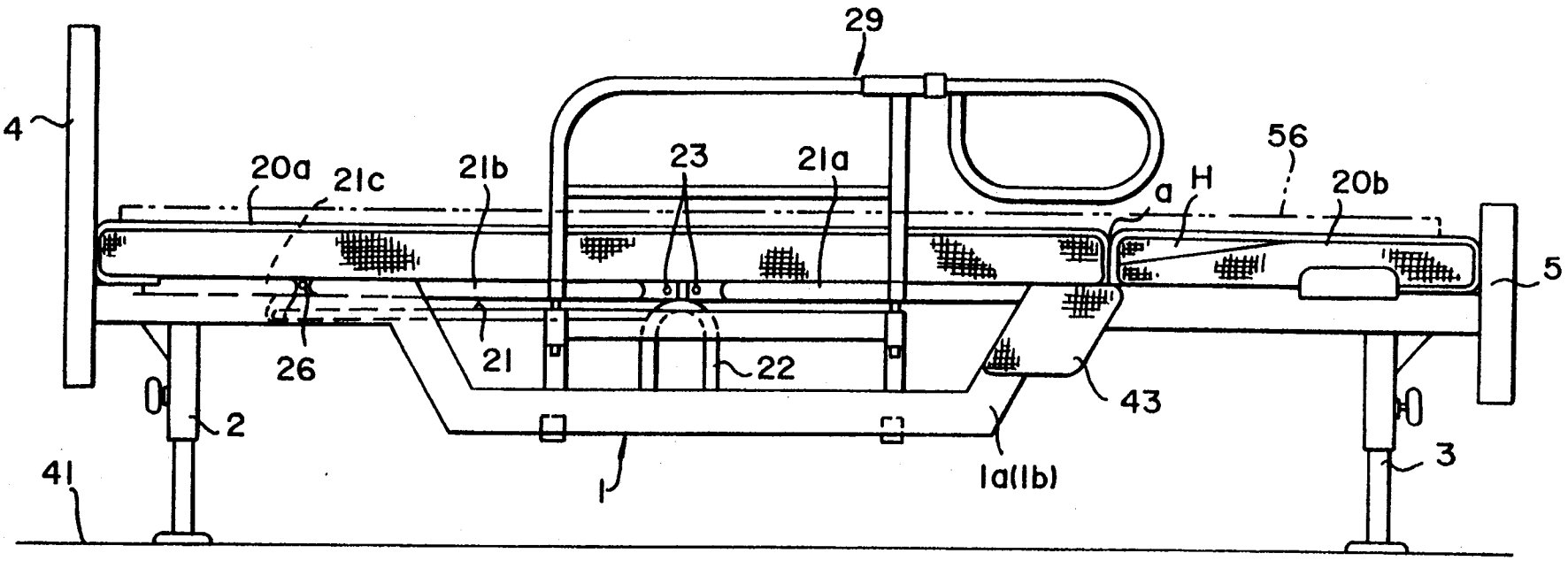
FIG. 24 is a side view of another embodiment.
Figure 25:
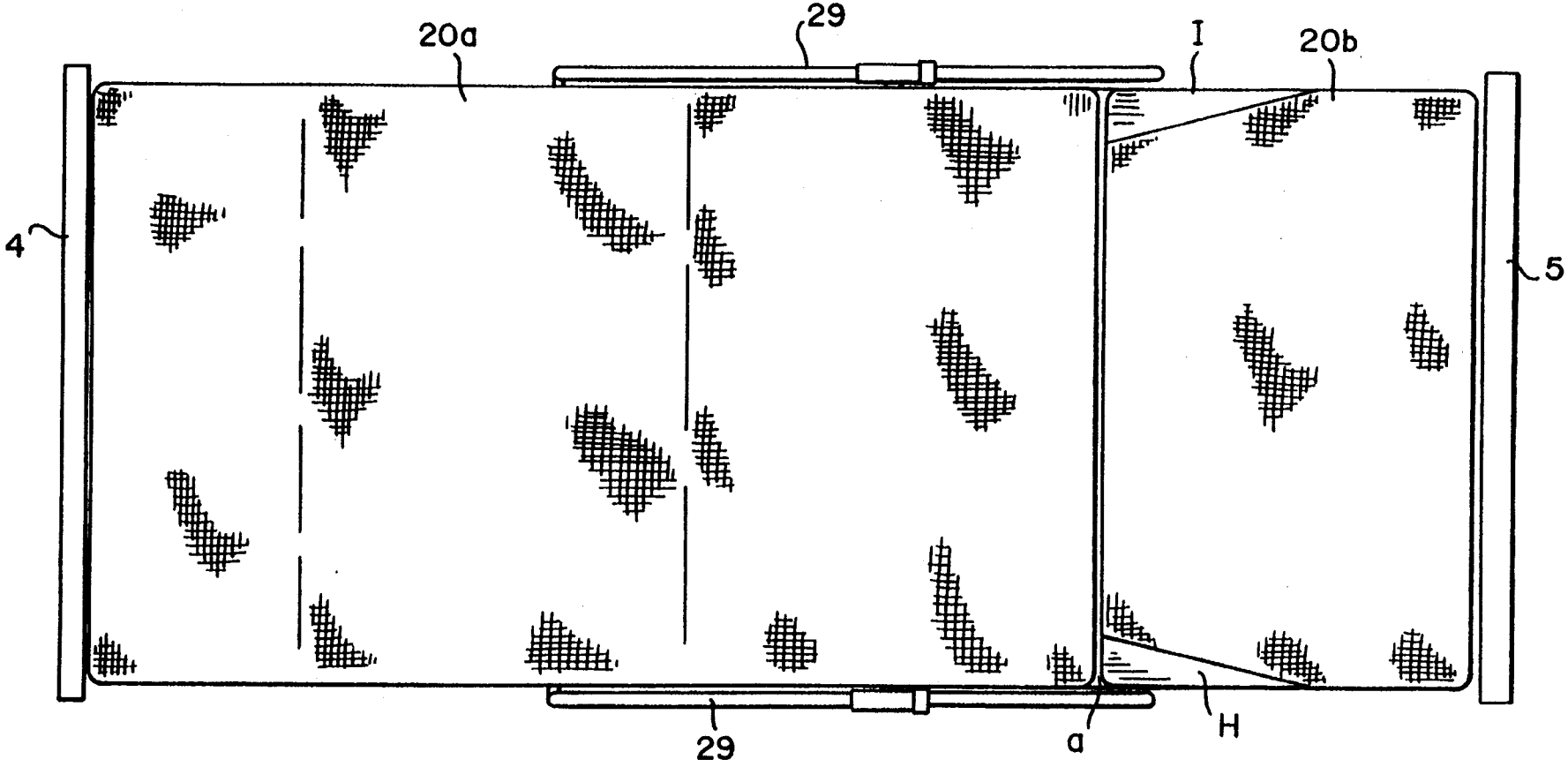
FIG. 25 is a plan view of the embodiment.
Figure 26:
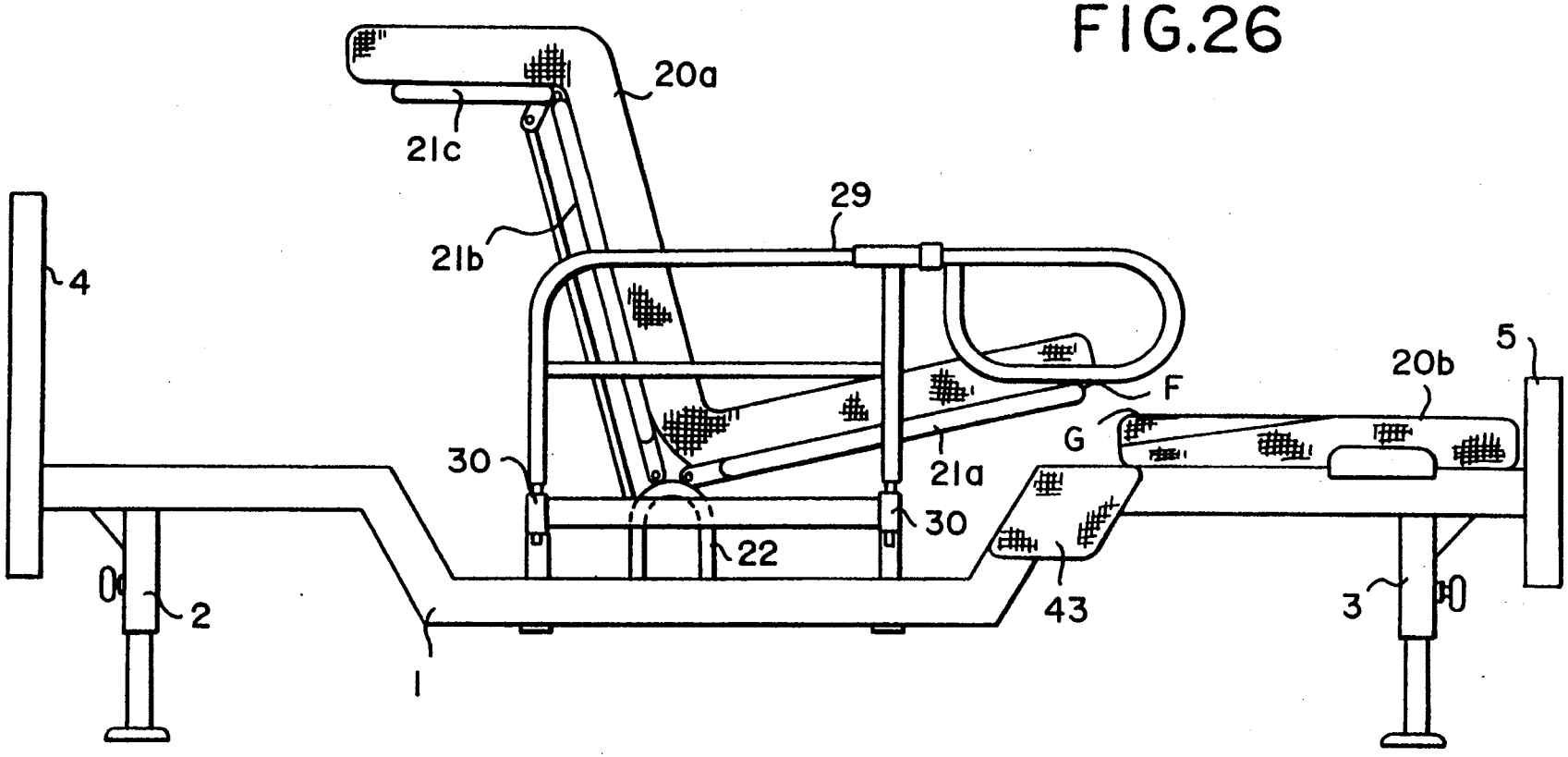
FIG. 26 is a side view showing a condition of a changed posture of the embodiment.
Figure 27:
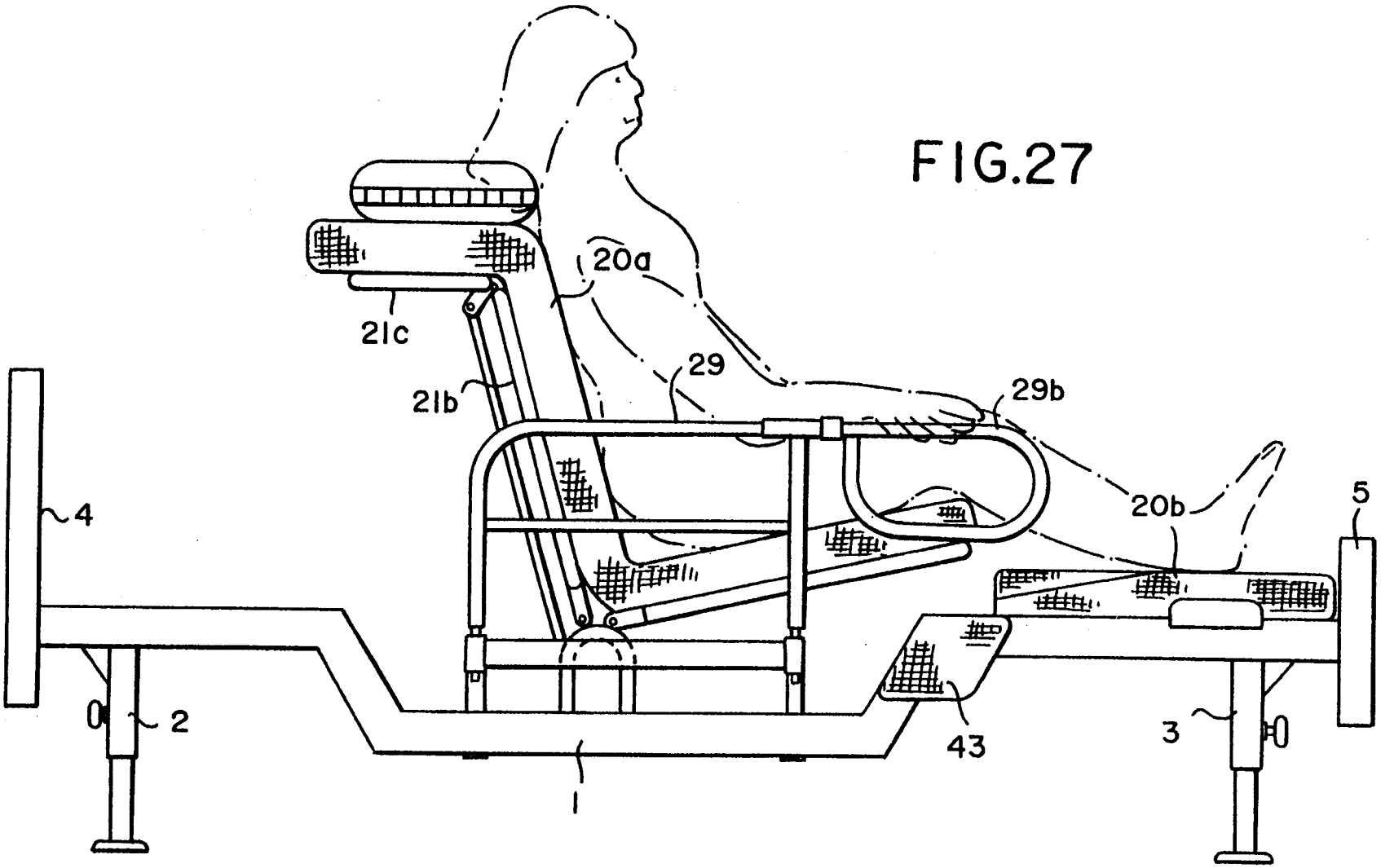
FIG. 27 is a side view showing a condition at a time when the pivoting of the embodiment is started.
Figure 28:
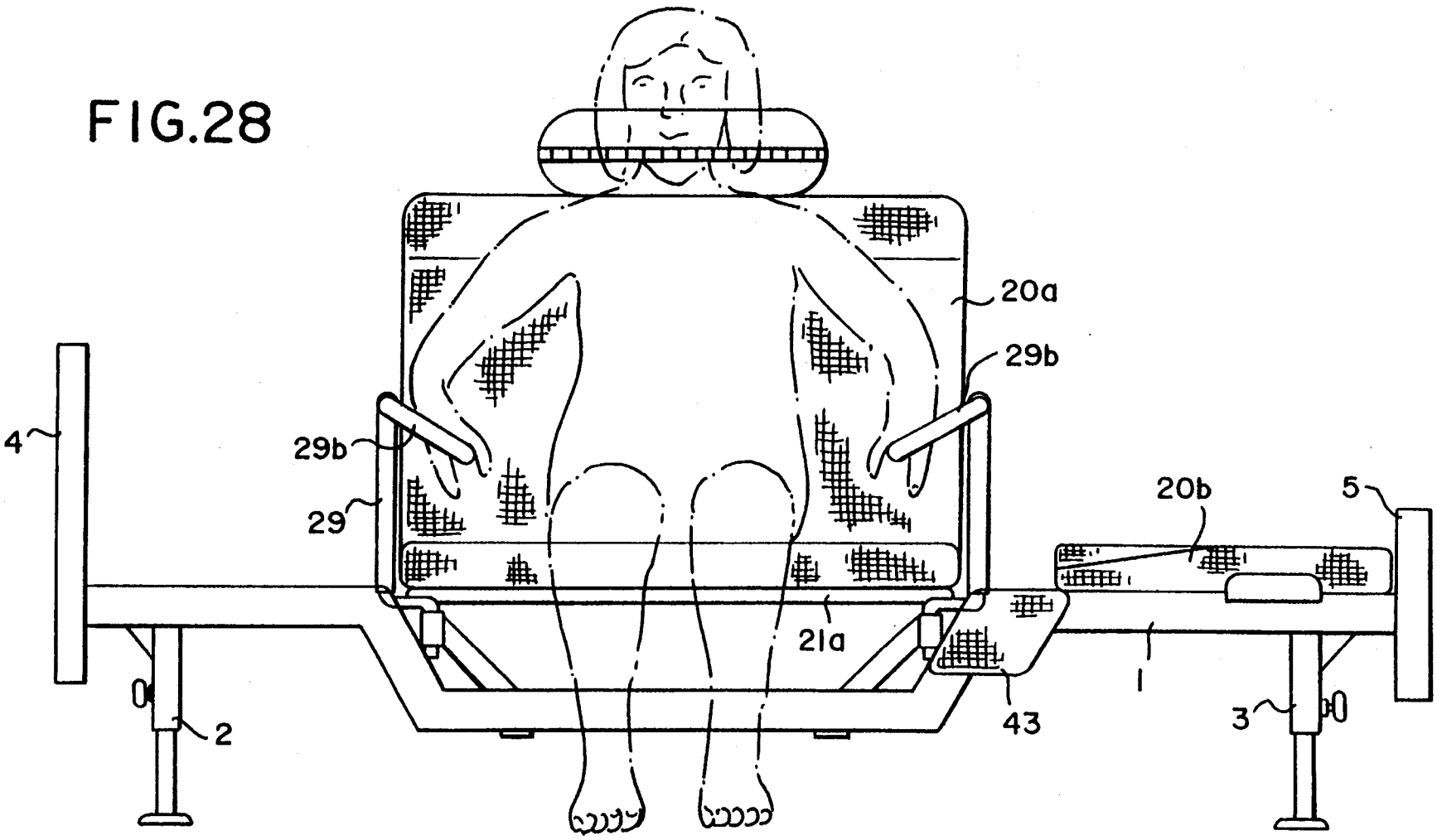
FIG. 28 is a side view showing a condition at a time when the pivoting has completed.

FIG. 24 and drawings that follow show an embodiment different from the above-described embodiment. In that invention, the front bed section **20*a* and the rear bed section 20*b* are formed in a rectangular shape when viewed from above. That is, the divided part is not formed in circular arc as in the above-described embodiment. Upper parts H and I of the right and left corners on the front side of the rear bed section 20*b* are inclined in a manner to be gradually lowered with respect to another part. The other part is substantially similar to the above-described embodiment, and the same numerals are assigned to the same parts. When the screw shaft 12 is rotated by the motor 10 to move the screw cylinder 13 forward for the pivoting of the waist supporting frame 21*a* and the back supporting frame 21*b*, the cam roller 36 is pushed by the front end vertical face of the cam 38 to gradually pivot the back supporting frame 21*b* backward in a manner not to strike against the board 4 during pivoting. Substantially at the same time, the cam roller 35 is gradually pushed up by the cam 37 to pivot the rear part of the waist supporting frame 21*a* upward in a manner not to strike against the rear bed section 20*b* during pivoting. That is, the collision preventive mechanism S, being one embodiment according to the present invention, is composed of the cam roller 35 mounted through the bracket 33 to the waist supporting frame 21*a* and of the cam 37**.

A femur guide 43 is arranged such that mat members thereof are mounted on the right and left wall faces of the fixed frame 1 corresponding to the dividing line between the front bed section **20*a* and the rear bed section 20*b*, and is designed to smoothly guide the femur to prevent it from being injured or to prevent nightclothes from being caught when the front bed section 20*a* is pivoted to cause the feet of a lying person to hang down toward the floor, or on the contrary when the front bed section 20*a*** is reversely pivoted with a person sitting on a chair to cause the person to be laid down on the bed.

Figure 29:
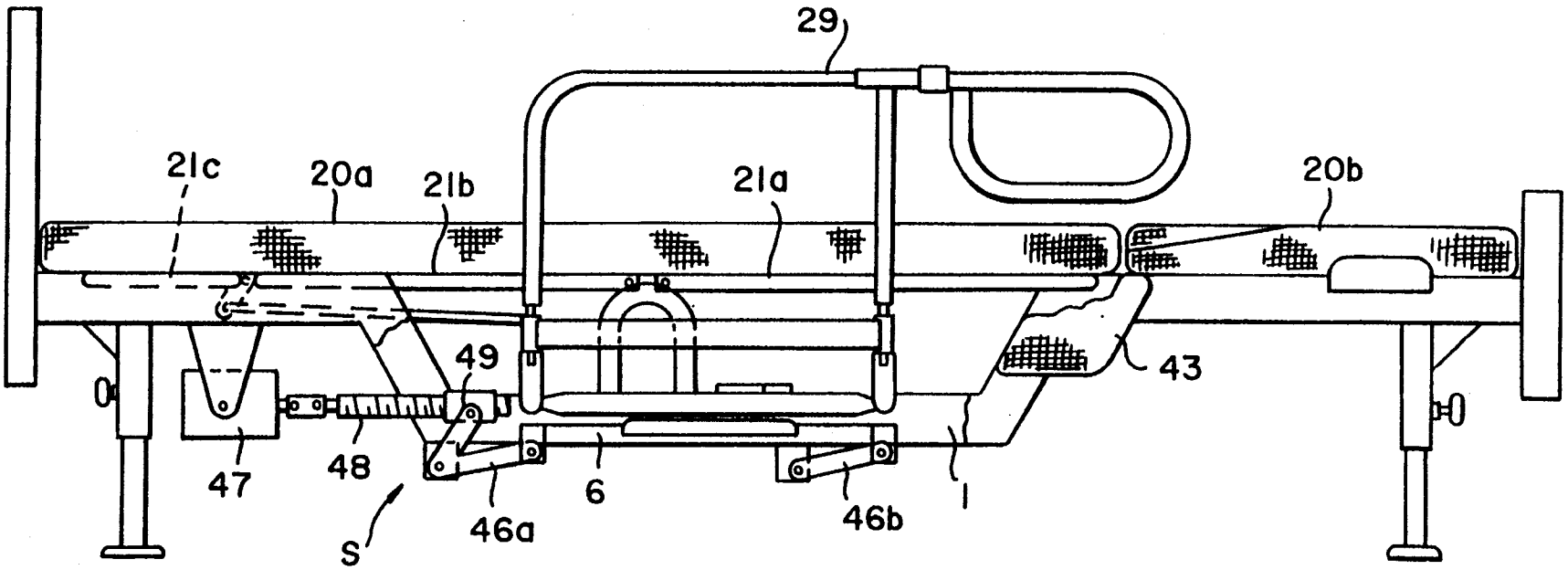
FIG. 29 is a partially cutaway side view of a further embodiment.
Figure 30:
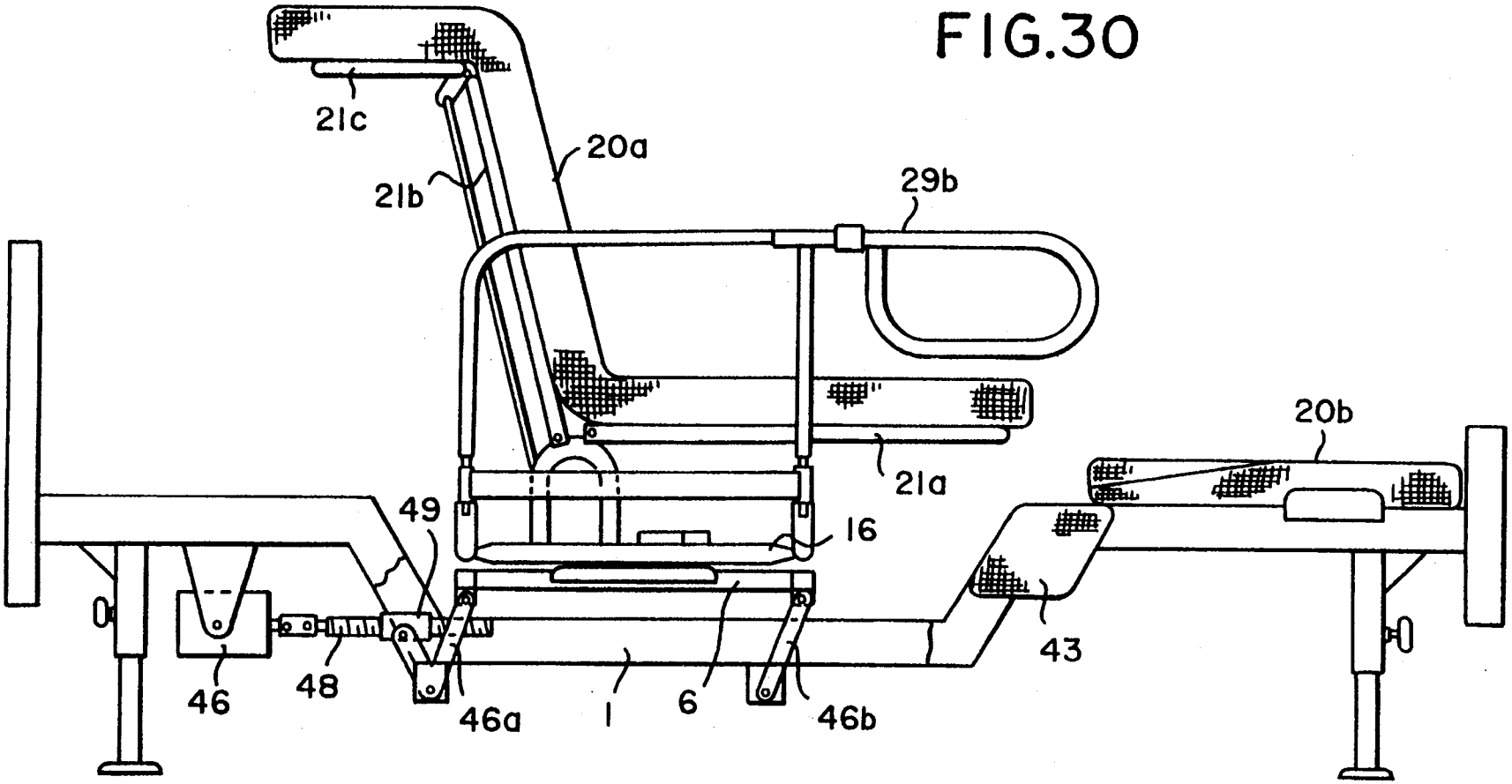
FIG. 30 is a side view showing the midway point of an actuation of the embodiment.
Figure 31:
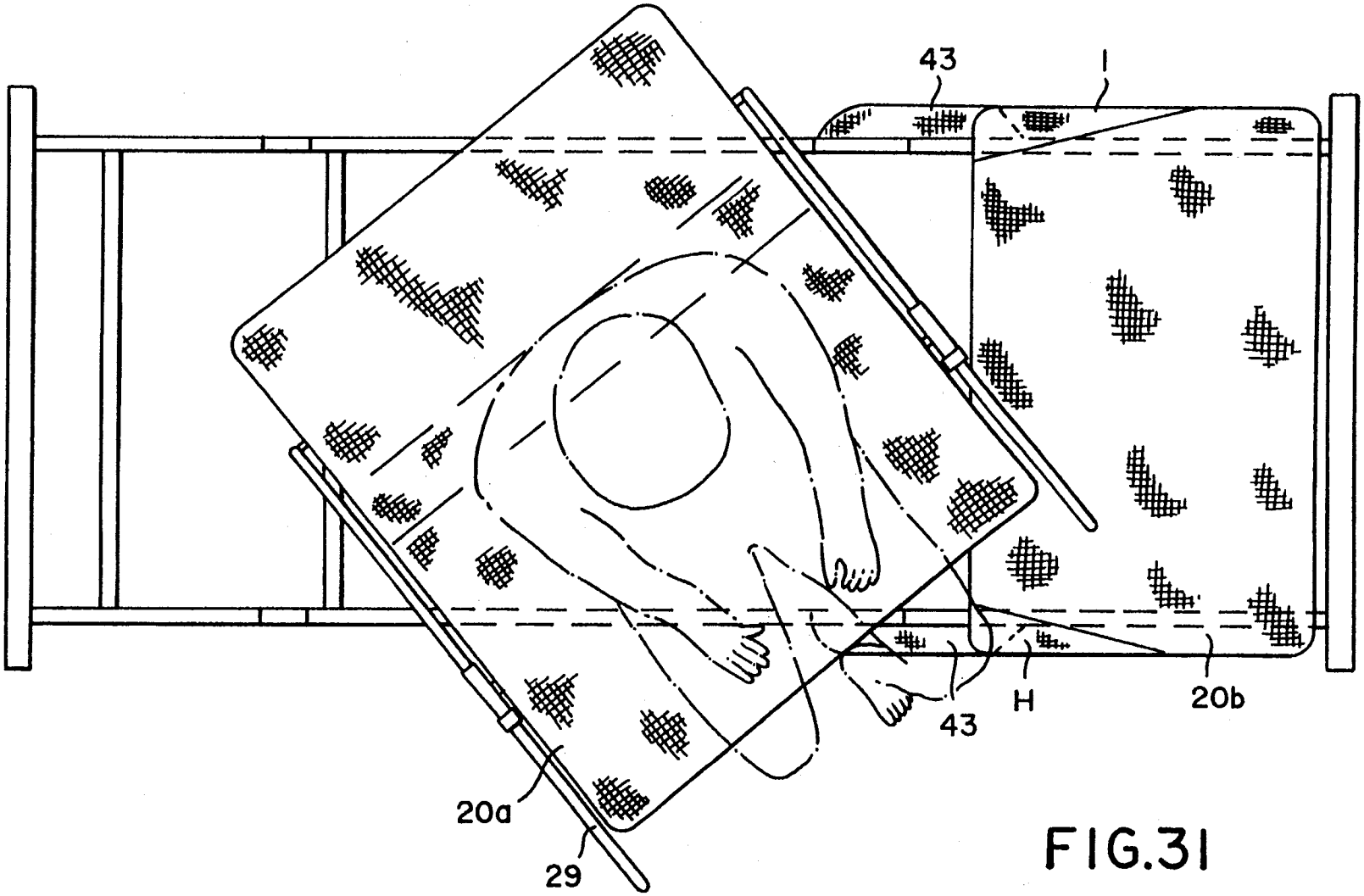
FIG. 31 is a plan view of the embodiment.

Besides the above-described embodiment, the collision preventive mechanism S may be arranged in such a manner as shown in the third embodiment in FIG. 29 where the pivoting frame 6 is provided movably upward and downward through a front link **46*a* and a rear link 46*b* on the fixed frame 1. The front link 46*a* is connected to a screw cylinder 49 thread engaged with a screw shaft 48 which is naturally or reversely rotated by a motor 47 for upward and downward movement mounted on the fixed frame 1 side. The pivoting frame 6 is moved upward by the nature and reverse rotation of the motor 47 as shown in FIG. 30 to make the front bed section 20*a* higher than the rear bed section 20*b*, thereby preventing collision of the two sections during pivoting. In this case, the operation mechanism composed of the roller 35 for diagonally moving the waist supporting frame 21*a*, the cam 37 and the like in the above-described embodiment is omitted. In the third embodiment, the natural and reverse rotation and the stoppage of the motor 47 are controlled by a controller 50 in a manner to be performed relating to the pivoting of the front bed section 20*a*. That is, when a switch 39*a* of a manual switch box 39 is set to ON, first the motor 47 is naturally rotated to move the front bed section 20*a* upward to cause the section to be in a condition as shown in Fig. 30. Then, the motor 10 begins to be rotated to move sideward and stop the front bed section 20*a*. Thereafter, the motor 47 is reversely rotated to move the front bed section 20*a* downward and stop. On the contrary, in order to allow a sitting person to lie on the bed, an operation reverse to the above-described operation is performed such that, when a switch 39***b* is set to ON, the motor 47 is reversely rotated to move the front bed section 20*a* upward and stop. Then, the motor 10 is reversely rotated to return the front bed section 20*a* to the original position in the forward-backward direction and stop the section. Thereafter, the motor 47 is reversely rotated to move the section to the original position as shown in FIG. 29 and stop the section.

Figure 32:
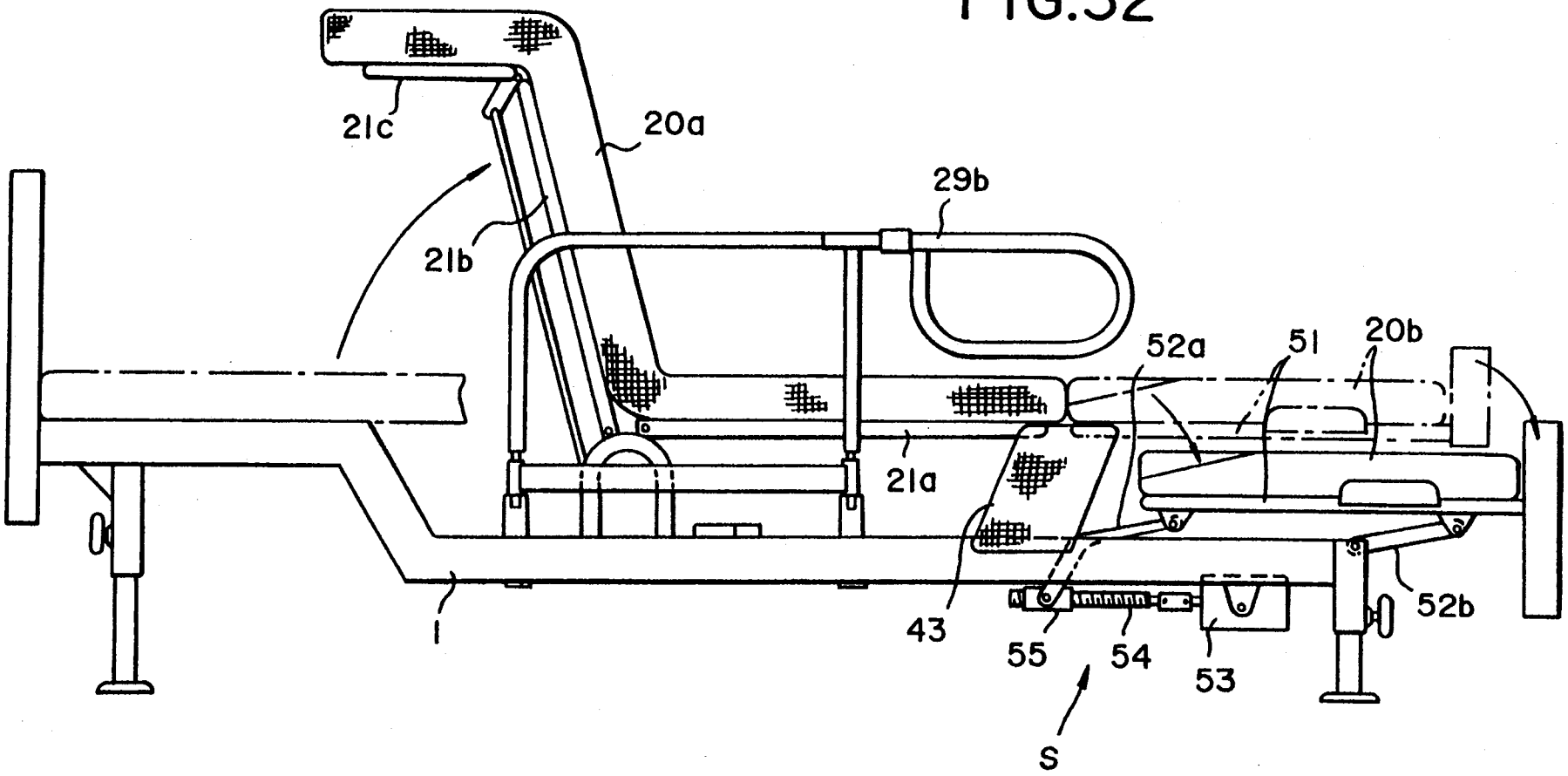
FIG. 32 is a side view of a still further embodiment.
Figure 33:
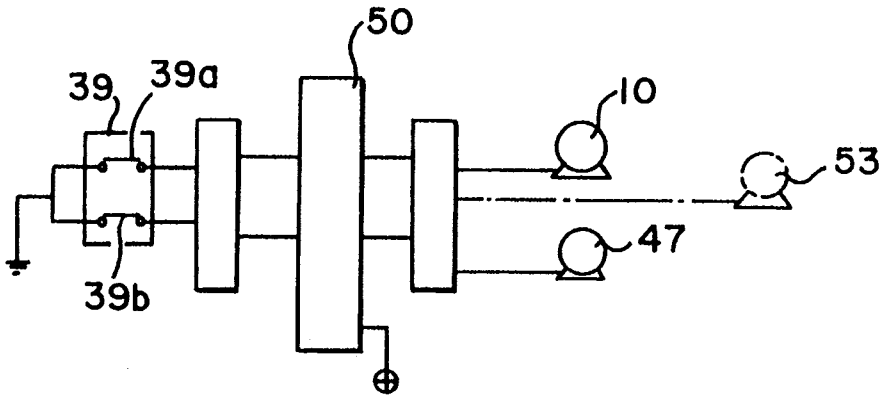
FIG. 33 is an electric control circuit diagram.

Besides the previous second and third embodiments, in an embodiment shown in FIG. 32, the collision preventive mechanism S is arranged such that the rear bed section 20*b* is supported by a rear bed supporting frame 51 which is movable upward and downward through links 53*a* and 53*b*. The link 53*a* is connected to a screw cylinder 55 threadly engaged with a screw shaft 54 which is naturally and reversely rotatable by a motor 53 mounted on the fixed frame 1. Thus, the rear bed section 20*b* is allowed to be lowered from the position shown with the virtual line to the position shown with the solid line in FIG. 32 to prevent the rear bed section 20*b* from colliding with the front bed section 20*a* when pivoted. In this case, it is also preferable that the motor 53 is automatically controlled by the controller as shown in the third embodiment.

However, in case of that fourth embodiment, when the switch 39*a* of the manual switch box 39 is set to ON, first the motor 53 is reversely rotated to move the rear bed section 20*b* downward. Then, the motor 10 begins to rotate to move the front bed section 20*a* sideward and stop. Thereafter, the motor 53 is naturally rotated to move the rear bed section 20*b* upward and stop. On the contrary, in order to allow a sitting person to lie on the bed, the controller is arranged such that, when the switch 39*b* is set to ON, as reverse to the above-described operation, the motor 53 is naturally rotated to move the rear bed section 20*b* downward and stop. Then, the motor 10 is reversely rotated to return the front bed section 20*a* to the original position in the forward-backward direction and stop the section. Thereafter, the motor 53 is naturally rotated to move the section to the original position and stop the section. The fourth embodiment is arranged such that the rear bed section 20*b* is moved downward to prevent a collision with the front bed section 20*a* when pivoted. Thus, it is not particularly necessary that the motor 10 begins to be rotated to move the front bed section 20*a* sideward and then the motor 53 is naturally rotated to move the rear bed section 20*b* upward, and thus that condition is left as it is. When a sitting person is allowed to lie on the bed, the controller may be arranged such that the motor 10 is reversely rotated as it is to pivot the front bed section 20*a* to the original position thereof,and then the motor 53 is naturally rotated to move the rear bed section 20*b* upward.

The upper-surface inclined parts H and I at the front side corners of the rear bed section 20*b* have such a function that, even where a sheet of thick bed quilt 56 is placed on the front and rear bed sections and the front bed section 20*a* is moved sideward together with the thick bed quilt as it is to cause the rear part of the thick bed quilt 56 placed on the rear bed section 20*b* to be hung down, when the front bed section 20*a* is pivoted and reset, the inclined parts automatically push up the hung-down thick bed quilt 56 onto the rear bed section 20*b* to effect the automatic raising of the front bed section 20*a*.

INDUSTRIAL AVAILABILITY OF UTILIZATION

As described above, the bed according to the present invention can be utilized as a bed used for a physically handicapped person or an aged person.

I claim:

1. A bed comprising:

a front bed section for receiving an upper half of a body at least above a femur;

a rear bed section for receiving a lower half of the body below a waist;

a supporting frame, receiving said front bed section, for pivoting when viewed from above to move sideward and for stopping said front bed section; and a collision preventive mechanism provided for separating said front bed section from said rear bed section, by moving one of said bed sections upward and downward, when the front bed section is pivoted to prevent end faces of the front and rear bed sections from colliding with each other.

* * * * *